US007298350B2

(12) United States Patent
Kitazawa et al.

(10) Patent No.: US 7,298,350 B2
(45) Date of Patent: Nov. 20, 2007

(54) IMAGE FORMING APPARATUS

(75) Inventors: Atsunori Kitazawa, Nagano-Ken (JP); Yujiro Nomura, Nagano-Ken (JP); Kiyoshi Tsujino, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 700 days.

(21) Appl. No.: 10/670,803

(22) Filed: Sep. 26, 2003

(65) Prior Publication Data

US 2005/0174419 A1 Aug. 11, 2005

(30) Foreign Application Priority Data

Sep. 26, 2002 (JP) ..... 2002-281029
Sep. 26, 2002 (JP) ..... 2002-281030
Sep. 26, 2002 (JP) ..... 2002-281031
Sep. 26, 2002 (JP) ..... 2002-281032
Sep. 26, 2002 (JP) ..... 2002-281033

(51) Int. Cl.
*H01J 1/62* (2006.01)

(52) U.S. Cl. ..... 345/76; 345/204; 345/207; 345/690; 315/169.1; 315/169.3

(58) Field of Classification Search ..... 345/76, 345/204, 207, 690; 315/169.1, 169.3; 347/130, 347/238; 399/39, 49, 51, 59; 430/126
See application file for complete search history.

(56) References Cited

U.S. PATENT DOCUMENTS 5,627,364 A * 5/1997 Codama et al. ..... 250/208.1
5,734,941 A * 3/1998 Teremy et al. ..... 396/315
5,994,019 A * 11/1999 Okado et al. ..... 430/126
5,998,008 A * 12/1999 Shimamura et al. ..... 428/323
6,091,203 A * 7/2000 Kawashima et al. ..... 315/169.3
6,505,010 B1 * 1/2003 Izumizaki et al. ..... 399/39
6,836,067 B1 * 12/2004 Imai ..... 313/504
6,998,209 B2 * 2/2006 Ikuno et al. ..... 430/57.3
2002/0005887 A1 * 1/2002 Nakase et al. ..... 347/134
2002/0190329 A1 * 12/2002 Arai et al. ..... 257/383
2003/0026624 A1 * 2/2003 Sakata et al. ..... 399/49
2003/0048351 A1 * 3/2003 Ohkubo ..... 347/238

FOREIGN PATENT DOCUMENTS

JP 8-32468 3/1996
JP 2534364 6/1996
JP 2000-127488 5/2000

* cited by examiner

*Primary Examiner*—Bipin Shalwala
*Assistant Examiner*—Vincent E. Kovalick
(74) *Attorney, Agent, or Firm*—Sughrue Mion, PLLC

(57) ABSTRACT

Image data is inputted from a data processing means 123 into storage means 124 so that light emitting elements of one line 128*a* of a light-emitting element (yellow) line head 128 are activated to expose pixels on an image carrier according to an output signal form a shift resistor 124*a*. The image carrier is moved in the direction of arrow X in such a manner that the pixels reach a position corresponding to the light emitting elements in a next line 128*b*. At this point of time, the image data are transmitted to a shift resistor 124*b* and then outputted to the line 128*b* so as to expose the pixels again. The image data are transmitted among the shift resistors sequentially by moving the image carrier, thereby sequentially repeatedly expose the same pixels.

52 Claims, 23 Drawing Sheets

FIG. 9

| BIT DATA NO. | BIT DATA | | | | | | | | GRADATION DATA |
|---|---|---|---|---|---|---|---|---|---|
| 1 | 0 | 0 | 0 | 0 | 0 | 0 | 0 | 0 | 0 |
| 2 | 0 | 0 | 0 | 0 | 0 | 1 | 0 | 0 | 4 |
| 3 | 0 | 0 | 0 | 0 | 1 | 0 | 0 | 0 | 8 |
| 4 | 0 | 0 | 0 | 1 | 0 | 0 | 0 | 0 | 16 |
| 5 | 0 | 0 | 1 | 0 | 0 | 0 | 0 | 0 | 32 |
| 6 | 0 | 1 | 0 | 0 | 0 | 0 | 0 | 0 | 64 |
| 7 | 1 | 0 | 0 | 0 | 0 | 0 | 0 | 0 | 128 |
| 8 | 1 | 1 | 1 | 1 | 1 | 1 | 1 | 1 | 255 |

IMAGE FORMING APPARATUS

BACKGROUND OF THE INVENTION

The present invention relates to an image forming apparatus which is structured to ensure stable amount of light when organic EL elements are used as light emitting elements in a line head and to reduce the deterioration of the elements.

In conventional image forming apparatus in which a latent image is written on an image carrier, it is common practice to employ an LED (light emitting diode) array as writing means. Line head in which light elements such as LEDs are aligned in plural lines has been developed. For example, Japanese Patent No. 2534364 discloses such a line head in which EL elements are used to form arrays. As the application of driving pulse to the EL elements is finished, the afterglow is reduced. Accordingly, as the driving pulse is applied after non-emission for a long time, the time required to reach a predetermined light intensity becomes longer and, in addition, the amount of emitted light becomes smaller. For this, in Japanese Patent No. 2534364 as the conventional example, an auxiliary pulse is applied at least once in one main scanning to light all of the EL elements. By applying the auxiliary pulse as mentioned above, the time required to reach the predetermined light intensity becomes short even after non-emission for a long time. The auxiliary pulse is set to have such intensity not to expose a photoreceptor and to produce afterglow. That is, the light emission is started in the state that afterglow exists.

Disclosed in Japanese Patent Publication No. H8-32468 is an examples of a line head in which light emitting elements using inorganic EL elements are aligned in plural arrays. For driving the line head using the inorganic EL elements, driving pulses are always applied from electrodes on both surfaces and the synchronous of these driving pulses is controlled to retain the potential of the synchronized pulse not to exceed a threshold value, thereby controlling the emission of light. However, according to this control method, direct current bias is applied to inorganic EL elements even during non-printing. As a pulse of which positive and negative are asymmetrical is applied, the deterioration inside a thin film of each inorganic EL element proceeds due to its characteristics, thus lowering the light output of the inorganic EL element. That is, as a direct current bias is applied to the inorganic EL element during the non-printing, the light output is lowered. For this, in Japanese Patent Publication No. H8-32468, a pulse of which positive and negative are symmetrical is applied during non-printing so as to prevent the deterioration of inorganic EL elements.

Further, organic compound as a component of the organic EL element has a characteristic of being susceptible to water. Therefore, Japanese Patent Unexamined Publication No. 2000-127488 describes a technique to solve this problem. That is, the temperature of the organic EL elements is detected and the remaining heat is controlled to retain the temperature of the organic EL elements when standby.

In the conventional example disclosed in the aforementioned Japanese Patent No. 2534364, the auxiliary pulse having such intensity as to produce afterglow is applied to the organic EL elements. This example has a problem that the deterioration of the EL elements is accelerated because the organic EL elements are actually lighted. In addition, in case of using organic EL elements as light emitting elements, the amount of emitted light is increased as the temperature increases due to application of voltage. That is, there is a problem that the amount of emitted light varies according to the variation in temperature of the organic EL elements. Because the deterioration of the organic EL element is accelerated by the light emission, there is also a problem that differences in degree of deterioration among the elements lead to variation in light emission.

In the conventional example disclosed in Japanese Patent Publication No. H8-32468, inorganic EL elements which deteriorate by application of direct current voltage are used and there is no disclosure about technology for correcting such variation in light emission among organic EL elements.

In the conventional example disclosed in Japanese Patent Unexamined Publication No. 2000-127488, there is no disclosure about the intensity of voltage to be applied to the organic EL elements in order to control the temperature. Application of voltage exceeding the light emitting voltage shortens the lives of the organic EL elements. There is a problem that structure of the line head is complex because a temperature detecting means is provided and the control circuit is complex because a temperature control circuit is added.

SUMMARY OF THE INVENTION

The present invention was made in view of the aforementioned problems of conventional techniques and the object of the present invention is to provide an image forming apparatus which is structured to ensure stable amount of light when organic EL elements are used as light emitting elements in a line head and to reduce the deterioration of the elements.

A first image forming apparatus according to the present invention achieving the aforementioned object comprises: an image writing means employing organic EL elements; a direct current voltage applying means for applying a direct current voltage to said organic EL elements; and a control means for said direct current applying means and is characterized in that said control means controls said direct current voltage applying means to apply a direct current voltage (Va), higher than 0V and lower than a threshold voltage, to said organic EL elements during non-printing. Accordingly, though the organic EL elements do not emit light, the temperature of the organic EL elements is increased because of Joule heat so that there is a little variation in electric current amount when the organic EL elements are set in the printing state, thus stabilizing the temperature. Therefore, stable amount of light can be obtained from the organic EL elements. Since the voltage lower than the threshold voltage is applied, the organic EL element can be prevented from being deteriorated. In addition, since the voltage to be applied during printing is changed from the voltage higher than 0V, not from "0V" to the predetermined value, the difference in potential between the non-printing state and the printing state is little, thereby obtaining good pulse responsiveness. Complex structure is not required for controlling the temperature of the organic EL elements, thereby simplifying the control circuit.

The first image forming apparatus is also characterized in that when conducting multiple exposure by said image writing means, said direct current applying means is controlled to apply a direct current voltage, higher than 0V and lower than the threshold voltage, to all organic EL elements arrange in at least one of the light emitting element lines. Therefore, when conducting multiple exposure, at least one of the light emitting element lines can be utilized as a means for increasing the temperature of the organic EL elements, not the image writing means.

Further, the first image forming apparatus is characterized in that said direct current applying means is controlled to apply a direct current voltage, higher than 0V and lower than the threshold voltage, to at least one of the organic EL elements arranged in said light emitting element lines. Therefore, a voltage lower than the direct current voltage to be applied to organic EL elements for single exposure is enough as the voltage to be applied to the organic EL elements for multiple exposure during non-printing. Accordingly, the allocation of voltage on the organic EL elements can be reduced, thus lengthening the lives of the organic EL elements.

A second image forming apparatus of the present invention comprises: an image carrier, an image writing means employing organic EL elements, a direct current voltage applying means for applying a direct current voltage to said organic EL elements; and a control means for said direct current applying means; and is characterized in that said control means controls said direct current voltage applying means to apply a direct current voltage (Va), higher than a threshold voltage and lower than the voltage applied for printing, to said organic EL elements during non-printing with said image carrier being moved. Accordingly, the organic EL elements emit lights such that a latent image is formed on the image carrier not to form a toner image. The temperature of the organic EL elements is increased because of Joule heat so that there is a little variation in electric current amount when the organic EL elements are set in the printing state, thus stabilizing the temperature. Therefore, stable amount of light can be obtained from the organic EL elements, thereby preventing the deterioration in image quality due to variation in light emission of organic EL elements. Since the voltage to be applied during printing is changed from the voltage higher than the threshold value, not from "0V" to the predetermined value, the difference in potential between the non-printing state and the printing state is little, thereby obtaining good pulse responsiveness. Complex structure is not required for controlling the temperature of the organic EL elements, thereby simplifying the control circuit.

The second image forming apparatus of the present invention is characterized in that when conducting multiple exposure by said image writing means, said direct current applying means is controlled to apply a direct current voltage, higher than a threshold voltage and lower than the voltage applied for printing, to all organic EL elements arrange in at least one of the light emitting element lines. Therefore, when conducting multiple exposure, at least one of the light emitting element lines can be utilized as a means for increasing the temperature of the organic EL elements, not the image writing means. It should be noted that, when the elements in only one line are lighted, no toner image is formed in case of multiple exposure. Therefore, the direct current voltage to be applied to said organic EL elements maybe equal to or higher than the direct current voltage to be applied for printing.

The second image forming apparatus of the present invention is also characterized in that said direct current applying means is controlled to apply a direct current voltage, higher than a threshold voltage and lower than the voltage applied for printing, to at least one of the organic EL elements arranged in said light emitting element lines. Therefore, a voltage lower than the direct current voltage to be applied to organic EL elements for single exposure is enough as the voltage to be applied to the organic EL elements for multiple exposure during non-printing. Accordingly, the allocation of voltage on the organic EL elements can be reduced, thus lengthening the lives of the organic EL elements.

In the first and second image forming apparatuses of the present invention, at the start of said image writing means, said direct current voltage (Va) is applied to said organic EL elements and then the image writing means is shifted to the printing state. Therefore, even when the image writing means starts and is shifted to the printing state with low ambient temperature, the temperature of the organic EL elements is increased so as to obtain the stable amount of light.

In the first and second image forming apparatuses of the present invention, said image writing means comprises a line head composed of light emitting element lines each of which has a plurality of organic EL elements aligned in the main scanning direction of the image carrier. Accordingly, stable amount of light can be obtained from the organic EL elements arranged in the line head, thus preventing the deterioration of the organic EL elements and lengthening the lives of the organic EL elements.

In the first and second image forming apparatuses of the present invention, said line head is composed of a plurality of said light emitting element lines aligned in the sub scanning direction. Therefore, the image carrier can be exposed to stable amount of light by using the line head composed of the organic EL elements two-dimensionally aligned.

In the first and second image forming apparatuses of the present invention, said organic EL elements are controlled according to the intensity modulating control. Therefore, it is not required to control the ON/OFF of the light emitting elements at a high speed. Even when the speed of response of the light emitting elements is low, this control can be adopted.

A third image forming apparatus of the present invention comprises: an image writing means employing organic EL elements and a control unit for said organic EL elements, wherein said control unit applies a voltage of opposite bias polarity i.e. a voltage of a polarity opposite to that of the voltage of bias polarity for light emission (voltage of emission polarity). Accordingly, residual carriers are removed from the light emitting layer, thereby obtaining stable amount of light. In addition, the amount of light is increased so that lower voltage is enough as the voltage applied to the organic EL elements, thereby preventing the deterioration of the organic EL elements.

In the third image forming apparatus, the application of a voltage of the opposite bias polarity is conducted as follows. (1) The absolute value of said voltage of the opposite bias polarity is set to be larger than the absolute value of said voltage of the emission polarity. Accordingly, the residual carriers can be moved from the light emitting layer at a higher speed than the moving speed of the carrier when light is emitted so that the residual carriers can be quickly removed from the light emitting layer. (2) The product of said voltage of the opposite bias polarity and its applying time is set to be larger than the product of said voltage of the emission polarity and its applying time. Accordingly, the energy of the carrier movement can be increased, whereby the residual carriers can be quickly removed from the light emitting layer. (3) At the start of said organic EL elements, said voltage of the opposite bias polarity is applied to the organic EL elements prior to the application of said voltage of the emission polarity. Accordingly, momentaneous variation in amount of emitted light at the start can be prevented.

(4) The voltage of the opposite bias polarity and the voltage of the emission polarity are alternatively applied to said organic EL elements. Accordingly, the organic EL element can always be in a state without residual carriers inside thereof when emitting light, thereby obtaining stable amount of light.

A fourth image forming apparatus of the present invention comprises: a charge bias applying means for a photoreceptor, a development bias applying means, organic EL elements in groups for forming an image on an image carrier, and a density control means for patch images, and is characterized in that said organic EL elements in group(s) are controlled to be all lighted before formation of the patch images. The organic EL elements in group(s) to be subjected to the all-element control may be the organic EL elements in all groups for forming image on the image carrier or the organic EL elements in one or some of the groups for forming image on the image carrier. Since the organic EL elements in group(s) are controlled to be all lighted before the formation of patch images as mentioned above, thereby forming stable patch images.

A fifth image forming apparatus of the present invention comprises: a charge bias applying means for a photoreceptor, a development bias applying means, organic EL elements in groups for forming an image on an image carrier, and a density control means for patch images, and is characterized in that it is controlled to form patch images in an order from the highest density to the lowest density stepwise. Accordingly, the higher the density is, the organic EL elements are exposed to larger amount of light so that stable light emission can be obtained in a short amount of time. The sensor sensibility of the patch sensor is lowered as the density is lower. Since the control for the patch pattern with higher density is preceded, the organic EL elements can be stabilized even if the sensor sensibility is lowered during the formation of pattern with low density. Therefore, the density of image can be uniformed.

A sixth image forming apparatus of the present invention comprises: a charge bias applying means for a photoreceptor, a development bias applying means, organic EL elements in groups for forming an image on an image carrier, and a density control means for patch images, is characterized in that said organic EL elements in group(s) are controlled to be all lighted before formation of the patch images and it is controlled to form patch images in an order from the highest density to the lowest density stepwise. Accordingly, the organic EL elements in all groups for forming image on the image carrier or the organic EL elements in one or some of the groups for forming image on the image carrier can have stablized light emission in a short amount of time when forming patch images, thereby uniforming the density of images.

In the fourth or sixth image forming apparatus, the organic EL elements in groups are controlled as follows. (1) The patch images are formed by controlling at least organic EL elements in group(s) which form the patch images to be all lighted. Accordingly, the amount of light can be uniformed when forming the patch images, thus uniforming the density of the patch images. The organic EL elements in group(s) which form the patch images are all lighted only before the formation of patch images, thus reducing the deterioration of the organic EL element of the group(s). (2) The organic EL elements in all groups are controlled to be all lighted before formation of the patch images. Accordingly, the organic EL elements in all groups are entirely stabilized, thereby reducing variation in amount of lights after the formation of patch images. (3) The organic EL elements in group(s) are controlled to be all lighted before application of the charge bias. Accordingly, no latent image is formed on the photoreceptor even though the organic EL elements in group(s) are all lighted, thereby preventing the generation of memories on the photoreceptor. That is, if the exposure is conducted after charging the photoreceptor, the potential of exposed portion may not be sometimes charged enough at the next charging process. This becomes memory on the photoreceptor, affecting the next image and thus deteriorating the image. According to the present invention, however, the organic EL elements in groups are all lighted before the application of the charge bias, thereby preventing the aforementioned problem. (4) The organic EL elements in group(s) are controlled to be all lighted before application of the development bias. Accordingly, since no toner image is formed on the photoreceptor even though the organic EL elements in the group are all lighted, thereby preventing wasteful consumption of toner. (5) The organic EL elements in group(s) are controlled to be all lighted at pauses in application of development bias. This case has an advantage that the amounts of lights are stabilized because the frequency of all-element lighting of the organic EL elements in the group(s) becomes higher.

A seventh image forming apparatus of the present invention comprises: an image writing means having a plurality of light emitting element lines aligned in the sub scanning direction of an image carrier, each light emitting element line being composed of a plurality of organic EL elements aligned in the main scanning direction of the image carrier and arranged two-dimensionally; and a control unit for said organic EL elements, and is characterized in that said control unit controls such that at least one organic EL element of the plural organic EL elements for forming a latent image of the same dot by means of multiple exposure is lighted at least once during the formation of the latent image of the same dot. The aforementioned organic EL elements include the elements corresponding to printing portions and the elements corresponding to non-printing portions or non-image portions. Accordingly, all of the organic EL elements have the opportunity to be lighted so as to prevent the generation of different in temperature among the organic EL elements, thus inhibiting the variation in light emission. In addition, since all of the organic EL elements have opportunities to be lighted, the levels of deterioration of the organic EL elements can be uniformed, thereby inhibiting the variation in amount of emitted light.

In the seventh image forming apparatus of the present invention, said control unit controls such that the organic EL elements corresponding to non-printing portions or non-image portions among said organic EL elements are at least once during the formation of the latent image of the same dot. Since only one of the organic EL elements corresponding to each non-printing portion is lighted, the latent image on the photoreceptor does not go far enough to form a toner image, thus not affecting the image formation. Therefore, the temperature of the organic EL elements can be increased so as to obtain stable amount of light without effect on the image formation. In addition, the organic EL elements corresponding to the non-printing portions or the non-image portions are lighted equally, thereby reducing the temperature difference relative to the organic EL elements corresponding to the printing portions. Therefore, the variation in amount of emitted light can be inhibited.

A eighth image forming apparatus of the present invention comprises: an image writing means having a plurality of light emitting element lines aligned in the sub scanning direction of an image carrier, each light emitting element line being composed of a plurality of organic EL elements aligned in the main scanning direction of the image carrier and arranged two-dimensionally; and a control unit for said organic EL elements, and is characterized in that said control unit controls such that organic EL elements of at least one of the light emitting element lines arranged in the main scanning direction are all lighted and the line to be subjected to the all-element lighting is switched at predetermined interval. Since the all-element lighting control is conducted relative to the organic EL elements of one line at each control, the all-element lighting control can be easily conducted. The latent image on the photoreceptor does not go far enough to form a toner image, thus not affecting the image formation. Therefore, stable amount of light can be obtained without effect on the image formation.

In the eighth image forming apparatus, the control unit conduct the following control. (1) The control unit controls such that the organic EL elements of one light emitting element line are all lighted once every formation of latent image of one main scanning line and the line to be all lighted is changed every main scanning line. Accordingly, the entire organic EL elements for multiple exposure can be all lighted equally for the same amount of time. In addition, the amount of light by the entire organic EL elements can be stabilized. (2) The control unit controls such that the number of times of all-element lightning to a light emitting element line is set to be higher when the light emitting element line is positioned farther from the center axis of a rod lens array. Organic EL elements have a tendency that elements farthest from the center axis of the rod lens array have the largest variation in amount of light. By increasing the number of times of all-element lightning relative to organic EL elements at a peripheral side as mentioned above, the variation in amount of light can be reduced. (3) The control unit controls such that the light emitting element line to be all lighted is changed every formation of image on page when the image is formed on a full page. Accordingly, since the light emitting element line to be subjected to the all-element lighting control is switched every page, the all-element lighting control for the organic EL elements can be easily conducted.

In the second, third, seventh, and eighth image forming apparatuses, said organic EL elements are connected to a driving circuit according to the active matrix method. Accordingly, this case has an advantage that the operation of the organic EL elements can be maintained even when the switching TFT is affected by disturbance or the like and thus turned OFF. In addition, when one pixel is repeatedly recorded, the operation can be maintained even during image data are transmitted from a storage means to the next storage means.

In the second, third, seventh, and eighth image forming apparatuses, a line head composed of organic EL elements to which the aforementioned control is conducted is mounted to an image carrier cartridge and a charging means, an exposure means, a developing means, and a transfer means are arranged around an image carrier, and in this state, a toner image formed on said image carrier is transferred onto a transfer medium. Accordingly, the image forming apparatus is structured to ensure stable amount of light of the image writing means and image formation without irregularity of image quality.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

BRIEF DESCRIPTION OF THE DRAWINGS

FIG. 9 is a table for explanation of the intensity modulating control;

DESCRIPTION OF THE PREFERRED EMBODIMENTS

Figure 1:
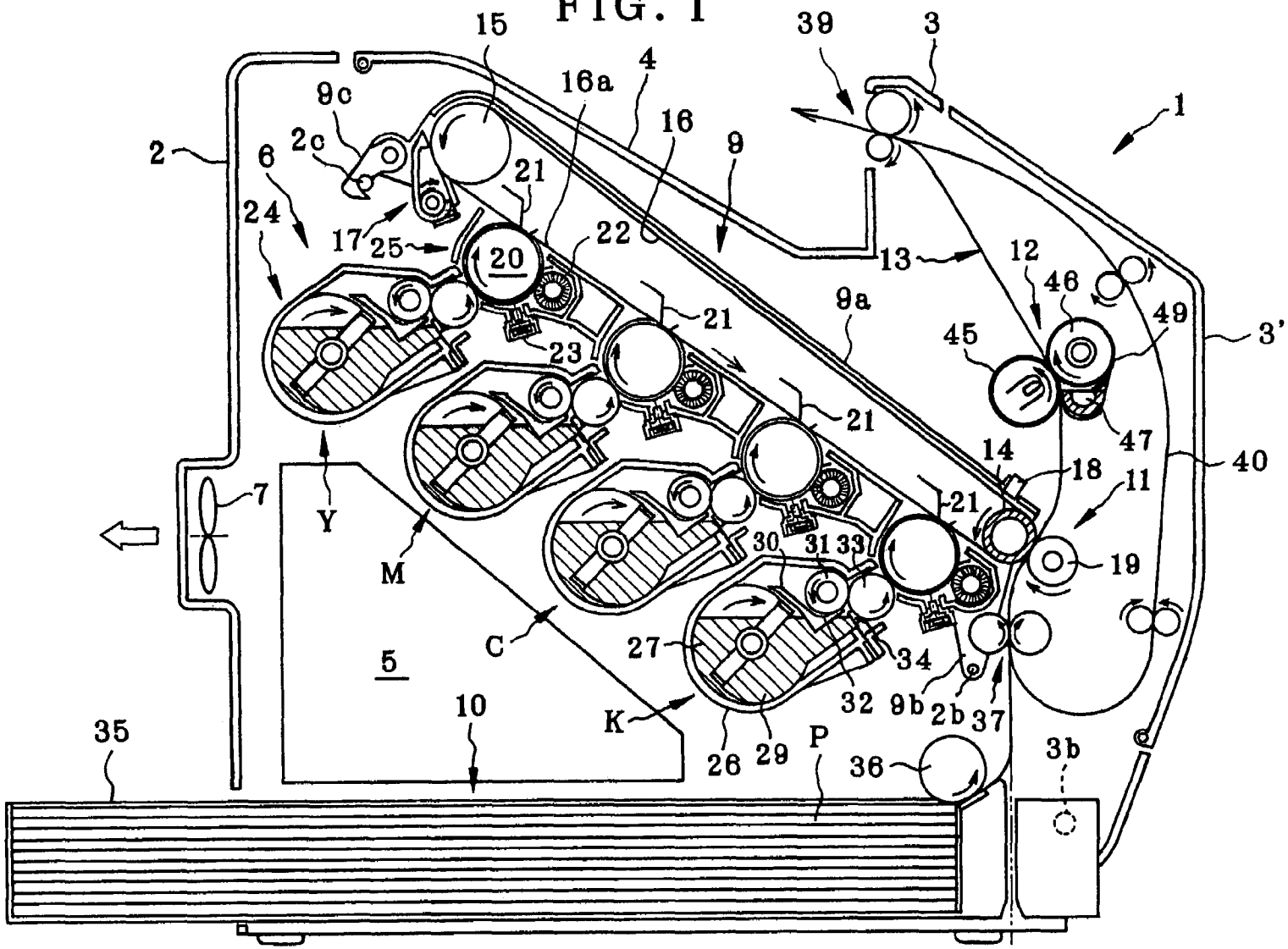
FIG. 1 is a schematic sectional view showing the entire structure of an image forming apparatus.

Hereinafter, an embodiment of an image forming apparatus according to the present invention will be described with reference to the attached drawings. FIG. 1 is a schematic sectional view showing the entire structure of the embodiment of the image forming apparatus to which the present invention is adopted. This embodiment is of a type employing an intermediate transfer belt as a transfer belt. In FIG. 1, the image forming apparatus 1 of this embodiment comprises a housing body 2, a first door member 3 which is disposed on the front of the housing body 2 such that the first door member is openable and closable, and a second door member (also functioning as an outfeed tray) 4 which is disposed on the top of the housing body 2 such that the second door member is openable and closable. The first door member 3 is provided with a lid 3' which is disposed such that the lid 3' is openable and closable relative to the front of the housing body 2. The lid 3' can be opened and closed in conjunction with or independently from the first door member 3.

Disposed in the housing body 2 are an electrical component box 5 in which substrates for power source circuits and substrates for control circuits are housed, an image forming unit 6, a blower fan 7, a transfer belt unit 9, and a paper feeding unit 10. Disposed in the first door member 3 are a secondary transfer unit 11, a fixing unit 12, and a recording medium carrying means 13. Expendable supplies in the image forming unit 6 and the paper feeding unit 10 are detachable relative to the body. In this case, the transfer belt unit 9 is detached together with the expendable supplies so as to allow its maintenance and replacement. The first door member 3 is attached to the lower front portion of the housing body 2 via pivotal shafts 3*b* disposed on both sides of the housing body 2 so that the first door member 3 is openable and closable about the pivotal shafts 3*b*.

The transfer belt unit 9 comprises a driving roller 14 which is disposed in a lower portion of the housing body 2 and is driven by a driving means (not shown) to rotate, a driven roller 15 which is disposed diagonally above the driving roller 14, an intermediate transfer belt 16 which is laid around the two rollers 14, 15 with some tension and is driven to circulate in a direction indicated by an arrow, and a cleaning means 17 which can abut on the surface of the intermediate transfer belt 16. The driving roller 14 and the driven roller 15 are rotatably supported by a support frame 9*a* which has a pivotal portion 9*b* formed at a lower end thereof. The pivotal portion 9*b* is fitted to a pivot shaft 2*b* disposed in the housing body 2, whereby the support frame 9*a* is attached to the housing body 2 such that it is pivotally movable.

In addition, the support frame 9*a* has a lock lever 9*c* which is rotatably disposed at an upper end thereof. The lock lever 9*c* can latch a latch pin 2*c* disposed on the housing body 2. The driving roller 14 also functions as a back-up roller for a secondary transfer roller 19 composing the secondary transfer unit 11. The driven roller 15 also functions as a back-up roller for the cleaning means 17. The cleaning means 17 is located at the belt face 16*a* side, of which traveling direction is downward. On the back of the belt surface 16*a*, of which traveling direction is downward, of the intermediate transfer belt 16, primary transfer members 21 composed of leaf spring electrodes are disposed. The primary transfer members 21 are pressed into contact with the back of the intermediate transfer belt 16 by their elastic force at locations corresponding to image carriers 20 of respective image forming stations Y, M, C, and K. A transfer bias is applied to each primary transfer member 21. In proximity to the driving roller 14, a test pattern sensor 18 is attached to the support frame 9*a* of the transfer belt unit 9. The test pattern sensor 18 is a sensor for positioning of toner images of respective colors on the intermediate transfer belt 16 and for compensating color registration error and densities of images of the respective colors by detecting image density of toner images of the respective colors.

The image forming unit 6 comprises the image forming stations Y (for yellow), M (for magenta), C (for cyan), and K (for black) for forming multi-color images (in this embodiment, four-color images). Each image forming station Y, M, C, K has an image carrier 20 composed of a photosensitive drum, a charging means 22, image writing means 23, and developing means 24 which are arranged around the image carrier 20. Reference numerals for the charging means 22, the image writing means 23, and the developing means 24 of the image forming station Y are indicated on the drawing and the indication of the reference numerals for the other image forming stations is omitted because the image forming stations have the same structure. It should be understood that the image forming stations Y, M, C, K may be arranged in any order.

The image writing means 23 employs an organic EL array exposure head in which organic EL light emitting elements are aligned in line(s) in the axial direction of the image carrier 20. The organic EL array exposure head is more compact than a laser scanning optical system because of its short optical path length so that the organic EL array exposure head can be arranged in proximity to the image carrier 20, thereby miniaturizing the entire apparatus. The image carrier 20, the charging means 22, and the image writing means 23 of each image forming station Y, M, C, K are united together into an image carrier unit 25. The image carrier unit 25 can be attached to and detached from the support frame 9*a* together with the transfer belt unit 9, thereby keeping the positions of the organic EL array exposure heads relative to the image carriers 20. When the image carrier unit 25 is replaced, the organic EL array exposure heads are also replaced together.

Then, details of the developing means 24 will be described by taking the image forming station K as an example. The developing means 24 each comprises the toner storage container 26 storing toner (indicating by hatching), a toner storage area 27 formed in the toner storage container 26, a toner agitating member 29 disposed inside the toner storage area 27, a partition 30 defined in an upper portion of the toner storage area 27, a toner supply roller 31 disposed above the partition 30, a blade 32 attached to the partition 30 to abut the toner supply roller 31, the development roller 33 arranged to abut both the toner supply roller 31 and the image carrier 20, and a regulating blade 34 arranged to abut the development roller 33. The image carrier 20 is rotated in the traveling direction of the intermediate transfer belt 16. The development roller 33 and the supply roller 31 are rotated in a direction opposite to the rotational direction of the image carrier 20 as shown by arrows. On the other hand, the agitating member 29 is rotated in a direction opposite to the rotational direction of the supply roller 31.

Toner returned to the toner storage area 27 is agitated with toner in the toner storage area 27 by the agitating member 29, and is supplied to a toner inlet near the supply roller 31 again. Therefore, the excess toner is let down to the lower portion without clogging the friction portion between the supply roller 31 and the development roller 33 and the contact portion between the development roller 33 and the regulating blade 34 and is then agitated with toner in the toner storage area 27, whereby the toner in the developing means deteriorates slowly so that portentous changes in image quality just after the replacement of the developing means is prevented.

The sheet supply unit 10 comprises a sheet cassette 35 in which a pile of recording media P are held, and a pick-up roller 36 for feeding the recording media P from the sheet cassette 35 one by one. Arranged inside the first door member 3 are a pair of resist rollers 37 for regulating the feeding of a recording medium P to the secondary transfer portion at the right time, a secondary transfer unit 11 as a secondary transfer means abutting on and pressed against the driving roller 14 and the intermediate transfer belt 16, a fixing unit 12, the recording medium carrying means 13, a pair of outfeed rollers 39, and a dual-side printing passage 40.

The fixing unit 12 comprises a fuser roller 45 which has a built-in heating element such as a halogen heater and which is freely rotatable, a pressure roller 46 pressing the fuser roller 45, a belt tensioning member 47 which is disposed to freely swing relative to the pressure roller 46, and a heat resistant belt 49 which is lied around the pressure roller 45 and the belt tensioning member 47. A color image secondarily transferred to a recording medium is fixed to the recording medium at the nip portion formed between the fuser roller 45 and the heat resistant belt 49 at a predetermined temperature.

The actions of the image forming apparatus as a whole will be summarized as follows:

(1) As a printing command (image forming signal) is inputted into the control circuit(s) in the electric component box 5 from a host computer (personal computer) (not shown) or the like, the image carriers 20 and the respective rollers of the developing means 24 of the respective image forming stations Y, M, C, K, and the intermediate transfer belt 16 are driven to rotate.

(2) The outer surfaces of the image carriers 20 are uniformly charged by the charging means 22.

(3) In the respective image forming stations Y, M, C, K, the outer surfaces of the image carriers 20 are exposed to selective light corresponding to image information for respective colors by the image writing means 23, thereby forming electrostatic latent images for the respective colors.

(4) The electrostatic latent images formed on the image carriers 20 are developed by the developing means 24 to form toner images, respectively.

(5) The primary transfer voltage of the polarity opposite to the polarity of the toner is applied to the primary transfer members 21 of the intermediate transfer belt 16, thereby transferring the toner images formed on the image carriers 20 onto the intermediate transfer belt 16 one by one at the primary transfer portions. According to the movement of the intermediate transfer belt 16, the toner images are superposed on the intermediate transfer belt 16.

(6) In synchronization with the movement of the intermediate transfer belt 16 on which primary images are primarily transferred, a recording medium P accommodated in the sheet cassette 35 is fed to the secondary transfer roller 19 through the pair of resist rollers 37.

(7) The primary-transferred image meets with the recording medium at the secondary transfer portion. A bias of the polarity opposite to the polarity of the primary-transferred image is applied by the secondary transfer roller 19 which is pressed against the driving roller 14 for the intermediate transfer belt 16 by the pressing mechanism, whereby the primary-transferred image is secondarily transferred to the recording medium fed in the synchronization manner.

(8) Residual toner after the secondary transfer is carried toward the driven roller 15 and is scraped by the cleaning means 17 disposed opposite to the roller 15 so as to refresh the intermediate transfer belt 16 to allow the above cycle to be repeated.

(9) The recording medium passes through the fixing means 12, whereby the toner image on the recording medium is fixed. After that, the recording medium is carried toward a predetermined position (toward the outfeed tray 4 in case of single-side printing, or toward the dual-side printing passage 40 in case of dual-side printing).

Figure 2:
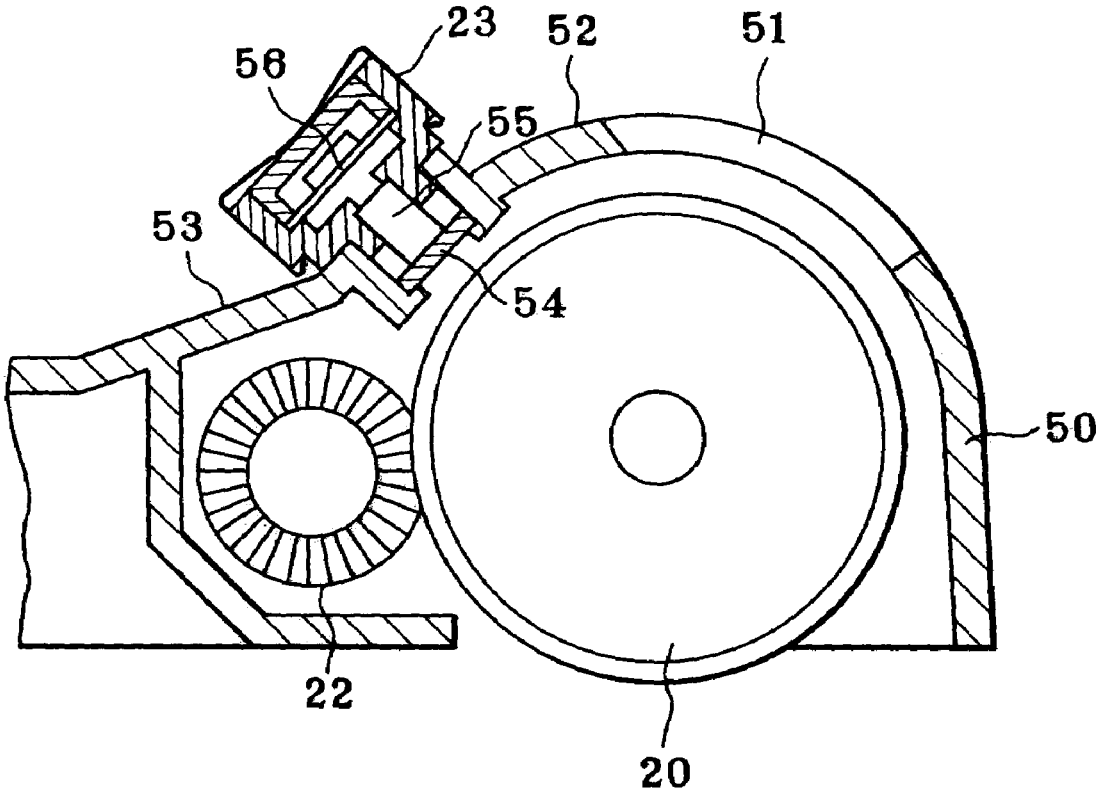
FIG. 2 is a sectional view on an enlarged scale partially showing a part of the image forming apparatus shown in FIG. 1.

FIG. 2 is a partial sectional view showing a portion around the image carrier 20 as shown in FIG. 1. The image carrier unit 25 comprises a casing 50 made of an opaque metallic plate or the like and having openings on a side confronting the intermediate transfer belt 16. In the casing 50, four image carriers (photosensitive drums) 20 of the image forming stations Y, M, C, and K are rotatably supported parallel to each other at certain intervals, conductive brush rollers as the charging means 22 are supported such that each charging means 22 rotates with being in contact with a predetermined position of each image carrier 20, organic EL array exposure heads as the image writing means 23 are positioned relative to the image carriers 20 and parallel to the image carriers 20 on downstream side than the charging means 22. Openings 51 are formed in the wall of the casing 50 on downstream side than the image writing means 23 so as to allow the development rollers 33 of the developing means 24 to be in contact with the image carriers 20, respectively. Between each opening 51 and each image writing means 23, a shielding portion 52 of the casing 50 remains. Between each charging means 22 and each image writing means 23, a shielding portion 53 of the casing 50 remains.

The shielding portions 52, 53, particularly the shielding portion 52 between the opening 51 and the image writing means 23, prevent ultraviolet rays from reaching the light emitting parts made of organic EL material from outside.

Numeral 54 designates a cleaning pad which wipes the gradient index type rod lens array 55 covering the front of the organic EL light emitting element array 56 when the gradient index type rod lens array 55 is contaminated. The cleaning pad 54 is reciprocated by means of a handle which is not shown.

Figure 3:
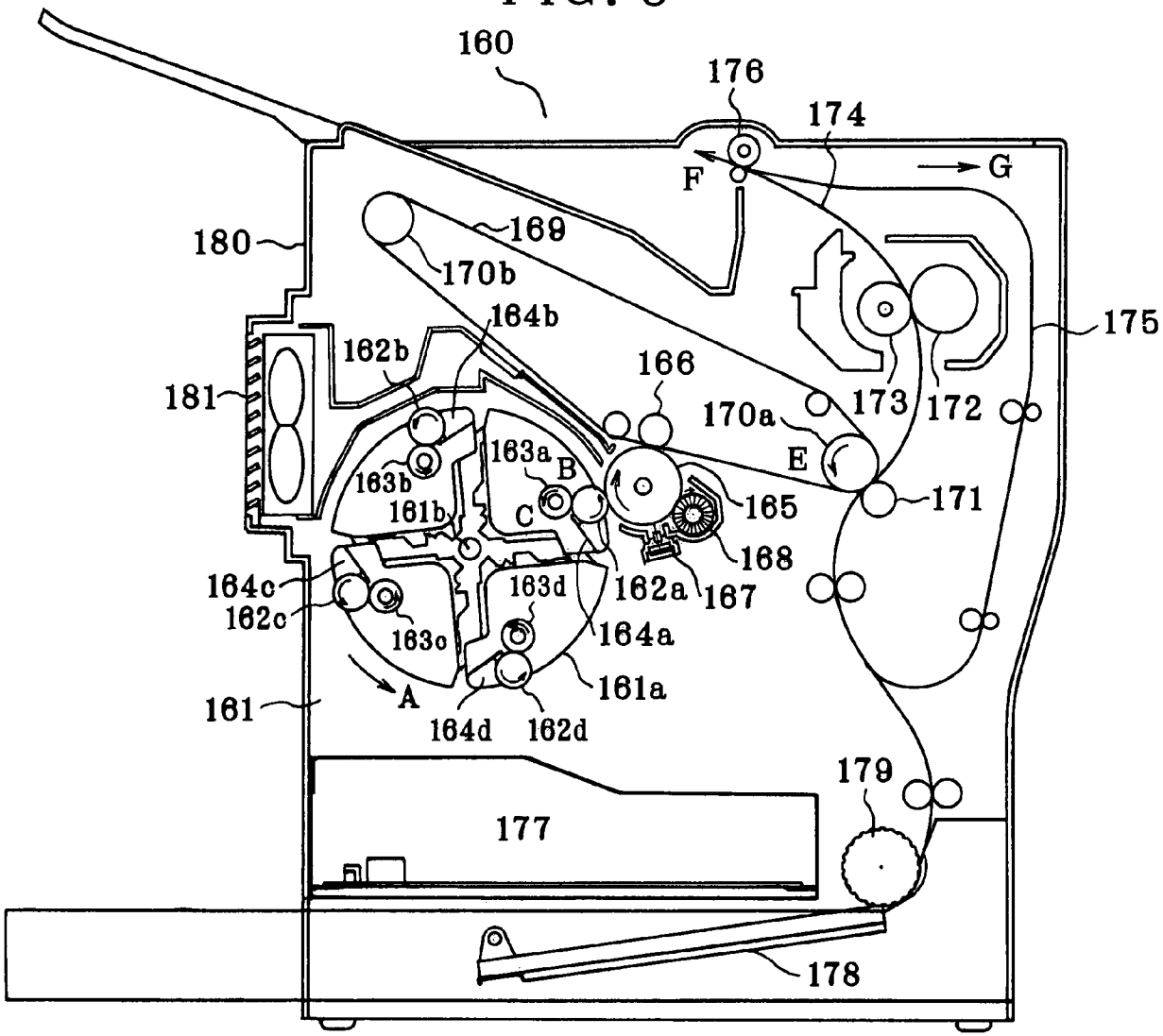
FIG. 3 is a schematic sectional view showing another example of an image forming apparatus.

Now, another embodiment of the image forming apparatus according to the present invention will be described. FIG. 3 is a structural view of an image forming apparatus to which the present invention is adopted. In FIG. 3, the image forming apparatus 160 comprises, as main components, a developing device 161 of a rotary type, a photosensitive drum 165 functioning as an image carrier, an image writing means 167 provided with organic EL array, an intermediate transfer belt 169, a paper feeding passage 174, a fuser roller 172 of a fixing device, and a paper sheet supply tray 178.

The developing device 161 has a development rotary 161*a* which rotates about a shaft 161*b* in a direction of arrow A. The inside of the development rotary 161*a* is divided in quarters in which image forming units for four colors, i.e. yellow (Y), cyan (C), magenta (M), and black (K) are arranged, respectively. Numerals 162*a* through 162*d* designate development rollers which are disposed in the aforementioned image forming units for four colors, respectively, to rotate in the direction of arrow B, and 163*a* through 163*d* designate toner supply rollers which rotate in the direction of arrow C, respectively. Numerals 164*a* through 164*d* designate regulating blades for regulating toner into a predetermined thickness, respectively.

Numeral 165 designates the photosensitive drum functioning as the image carrier as mentioned above, 166 designates a primary transfer member, 168 designates a charging device, 167 designates the image writing means in which the organic EL array is provided. The photosensitive drum 165 is driven by a driving motor (not shown) such as a stepping motor in the direction of arrow D which is opposite to the direction of the development roller 162*a*. The intermediate transfer belt 169 is laid around the driven roller 170*b* and the driving roller 170*a* with some tention. The driving roller 170*a* is connected to the driving motor of the photosensitive drum 165 and transmits power to the intermediate transfer belt. By driving the driving motor, the driving roller 170*a* of the intermediate transfer belt 169 is rotated in the direction of arrow E opposite to the direction of the photosensitive drum 165.

On the paper feeding passage 174, a plurality of feeding rollers and a pair of outfeed rollers 176 are arranged to feed paper sheets. An image (toner image) on one side of the intermediate transfer belt 169 is transferred to one side of a paper sheet at the position of a secondary transfer roller 171. The secondary transfer roller 171 is shifted to be in contact with or apart from the intermediate transfer belt 169 by a clutch. When the clutch is ON, the secondary transfer roller 171 is brought in contact with the intermediate transfer belt 169, whereby the image is transferred to the paper sheet. The paper having the transferred image thereon is subjected to fixing treatment by a fixing device having a fusing heater H. The fixing device comprises a fuser roller 172 and a pressure roller 173. The paper sheet after the fixing treatment is drawn by the pair of outfeed rollers 176 to proceed in the direction of arrow F. As the outfeed rollers 176 are reversely rotated in this state, the paper sheet reverses its proceeding course so as to proceed into a dual-side printing passage 175 in the direction of arrow G. Numeral 177 designates an electrical component box, 178 designates the paper sheet supply tray, and 179 designates a pick-up roller provided at the outlet of the paper sheet supply tray 178.

In the paper feeding passage, a low-speed brushless motor is employed as the driving motor for driving the feeding rollers. The intermediate transfer belt 169 employs a stepping motor because compensation of color registration error is required. These motors are controlled with signals from a control means which is not shown. In the state shown in FIG. 3, electrostatic latent images for yellow (Y) are formed on the photosensitive drum 165. By applying high voltage to the development roller 162*a*, yellow images are formed on the photosensitive drum 165. As the yellow images for the back side and the front side are completely carried by the intermediate transfer belt 169, the development rotary 161*a* is rotated by 90 degree in the direction of arrow A.

The intermediate transfer belt 169 turns full circle once to return to the position of the photosensitive drum 165. Next, cyan (C) images for dual sides are formed on the photosensitive drum 165. Then, these images are carried on the intermediate transfer belt 169 such that these images are superposed on the yellow images carried on the intermediate transfer belt 169. After that, the rotation of the development rotary 161*a* by 90 degree and the full circle turn of the intermediate transfer belt 169 after carrying images are repeated in the same manner. For carrying images for four colors, the intermediate transfer belt 169 turns the full circle four times and, after that, is controlled in its rotational position such that the images are transferred to a paper sheet at the position of the secondary transfer roller 171. The paper sheet supplied from the paper sheet supply tray 178 is fed through the feeding passage 174. The aforementioned color image is transferred to one side of the paper sheet at the position of the secondary transfer roller 171. The paper sheet with the transferred image on one side thereof is reversed at the pair of outfeed rollers 176 as mentioned above and waits at the feeding passage. After that, the paper sheet is fed to the position of the secondary transfer roller 171 at the right time so that the aforementioned color image is transferred to the other side of the paper sheet. The housing 180 is provided with a blower fan 181.

Figure 4:
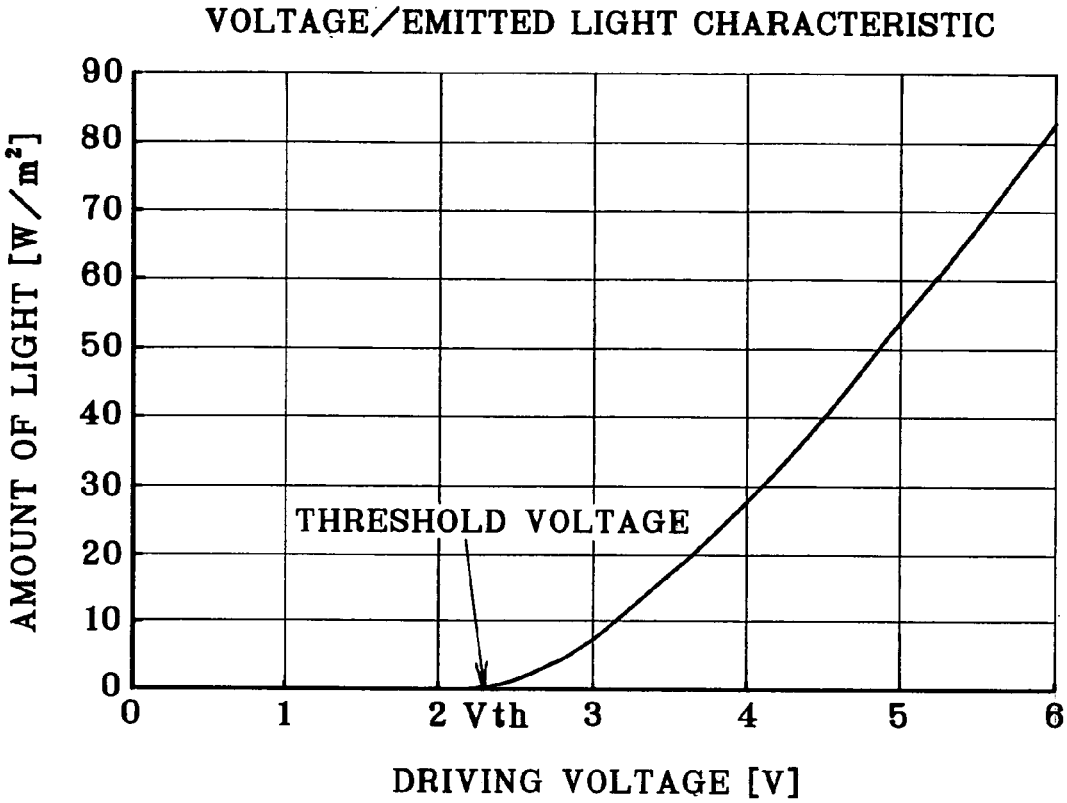
FIG. 4 is a characteristic graph showing the voltage/emitted light characteristic according to the present invention.

FIG. 4 is a characteristic graph showing an example of the voltage/emitted light characteristic (the relation between the voltage and the amount of emitted light) of each organic EL element. In FIG. 4, the axis of abscissa indicates the driving voltage (V) and the axis of ordinate indicates the amount of light ($W/m^2$). The organic EL element has a diode characteristic as shown in FIG. 4 so that the light emission starts when the applied driving voltage exceeds a voltage (threshold voltage "Vth") higher than 0V. In the example of FIG. 4, the amount of emitted light is increased along a curve of hyperbolic function relative to the driving voltage after the threshold voltage "Vth".

In the present invention, a direct current voltage higher than 0V and lower than the threshold voltage "Vth" in FIG. 4 is applied to the organic EL element during non-printing. That is, a direct current voltage which is such a low voltage that the light emission does not start and minute current flows inside the organic EL element is applied to the organic EL element. During this, the temperature of the organic EL elements is increased because of Joule heat. Therefore, there is a little variation in electric current amount when the organic EL elements are set in the printing state, thus obtaining stable temperature. According to the present invention, therefore, stable amount of light can be obtained from the organic EL elements. Since the voltage lower than the threshold voltage is applied, the organic EL element can be prevented from being deteriorated.

Figure 5:
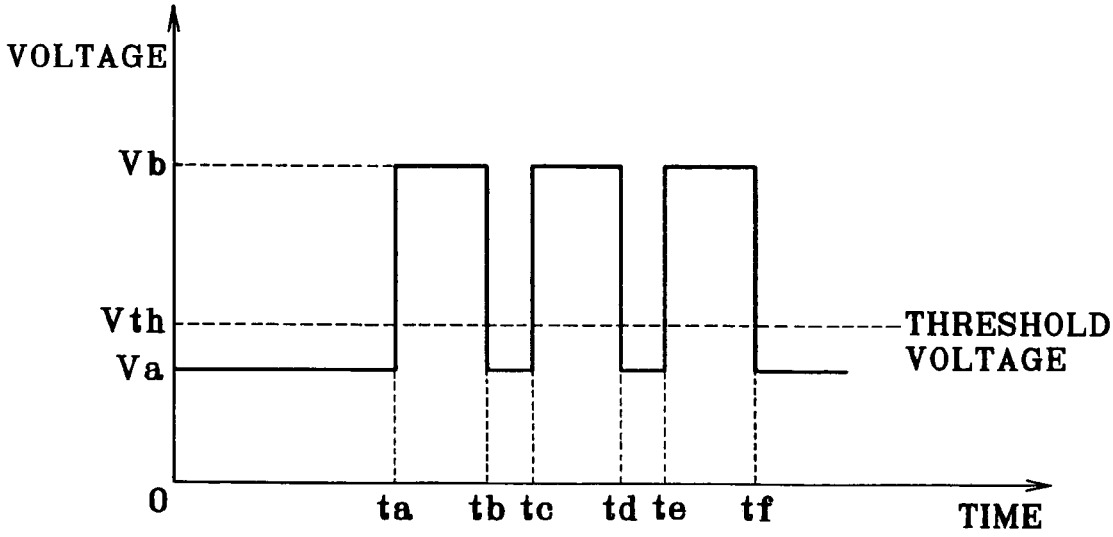
FIG. 5 is a characteristic chart showing a voltage waveform according to the present invention.

FIG. 5 is a waveform chart showing an example of voltage pulse to be applied to the organic EL element according to the present invention. In FIG. 5, the axis of abscissa indicates the time. The axis of ordinate indicates the voltage. "Vth" as a voltage value is the aforementioned threshold voltage, "Va" is a direct current voltage higher than 0V and lower than the threshold voltage, and "Vb" is the highest value in the driving voltage applied to the organic EL higher than the threshold voltage.

Now, the control for organic EL element according to the present invention will be described. The direct current voltage "Va" higher than "0V" and lower than the threshold voltage is applied to the organic EL element during non printing in a time period from time "0" to time "ta". The voltage "Vb" is applied to the organic EL element in a time period from time "ta" to time "tb" so that the organic EL element becomes to the printing state. The voltage "Va" is applied between time "tb" and time "tc" and between time "td" and time "te", while the voltage "Vb" is applied between time "tc" and time "td" and between time "te" and time "tf".

In this manner, the voltage "Va" and the voltage "Vb" are alternatively applied. The driving voltage is changed from the direct current voltage "Va" higher than 0V and lower than the threshold voltage "Vth" to the voltage "Vb", not from "0V" to "Vb". Therefore, the difference in potential between the non-printing state and the printing state is little, thereby obtaining good pulse responsiveness. The control for the voltage to be applied to the organic EL element is ON/OFF control between "Va" and "Vb", not complex control just like the temperature control, thereby simplifying the control circuit. In addition, the aforementioned "Va" is applied at the start so as to increase the temperature until the printing is started. Therefore, the stable amount of light can be obtained even at the start when the ambient temperature is low.

In another embodiment of the present invention, a direct current voltage higher than the threshold value "Vth" in FIG. 4 and lower than the applied voltage for printing is applied to the organic EL element in a state that the image carrier is moved during non-printing. That is, the organic EL element emits light and forms a latent image on the image carrier, but no toner image is formed. During this, the temperature of the organic EL element is increased because of Joule heat. Therefore, the variation in electric current amount when the organic EL element is set in the printing state is little, thus obtaining stable temperature. According to the present invention, therefore, stable amount of light can be obtained from the organic EL element, thereby preventing the deterioration in image quality due to variation in light emission.

Figure 6:
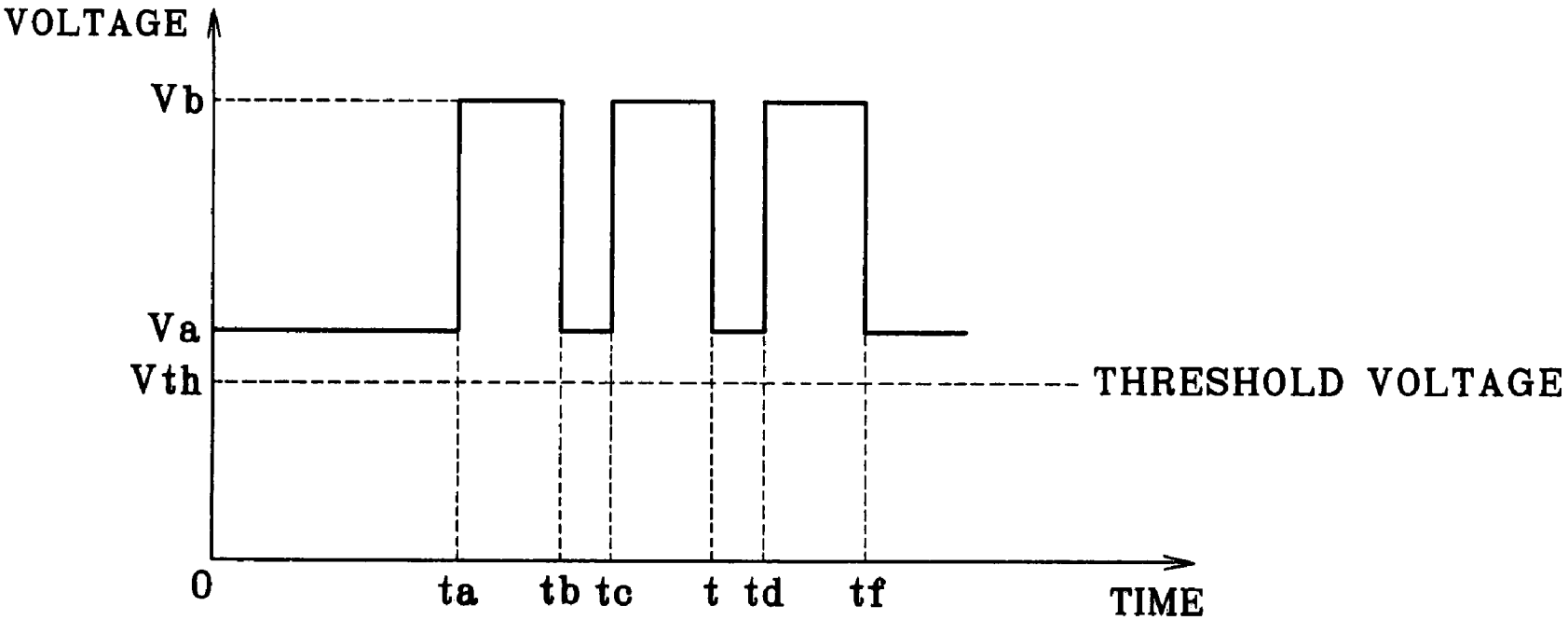
FIG. 6 is a characteristic chart showing a voltage waveform according to another embodiment of the present invention.

FIG. 6 is a waveform chart showing an example of voltage pulse to be applied to the organic EL element according to the another embodiment of the present invention. In FIG. 6, the axis of abscissa indicates the time. The axis of ordinate indicates the voltage. "Vth" as a voltage value is the aforementioned threshold voltage, "Va" is a direct current voltage higher than the threshold voltage, and "Vb" is the voltage applied to the organic EL during printing. The magnitude of the direct current voltage "Va" is higher than the threshold voltage and lower than the voltage applied during printing as mentioned above.

Now, the control for organic EL element according to the present invention shown in FIG. 6 will be described. The direct current voltage "Va" higher than the threshold voltage is applied to the organic EL element during non printing in a time period from time "0" to time "ta", in a state that the image carrier is moved. Accordingly, the organic EL element emits light and forms a latent image on the image carrier, but no toner image is formed. The voltage "Vb" is applied to the organic EL element in a time period from time "ta" to time "tb" so that the organic EL element becomes to the printing state. The voltage "Va" is applied between time "tb" and time "tc" and between time "td" and time "te", while the voltage "Vb" is applied between time "tc" and time "td" and between time "te" and time "tf".

In this manner, the voltage "Va" and the voltage "Vb" are alternatively applied. The driving voltage is changed from the direct current voltage "Va" higher than the threshold voltage "Vth" to the voltage "Vb", not from "0V" to "Vb". Therefore, the difference in potential between the non-printing state and the printing state is little, thereby obtaining good pulse responsiveness. The control for the voltage to be applied to the organic EL element is ON/OFF control between "Va" and "Vb", not complex control just like the temperature control, thereby simplifying the control circuit. In addition, the aforementioned "Va" is applied at the start so as to increase the temperature until the printing is started. Therefore, the stable amount of light can be obtained even at the start when the ambient temperature is low.

Figure 7:
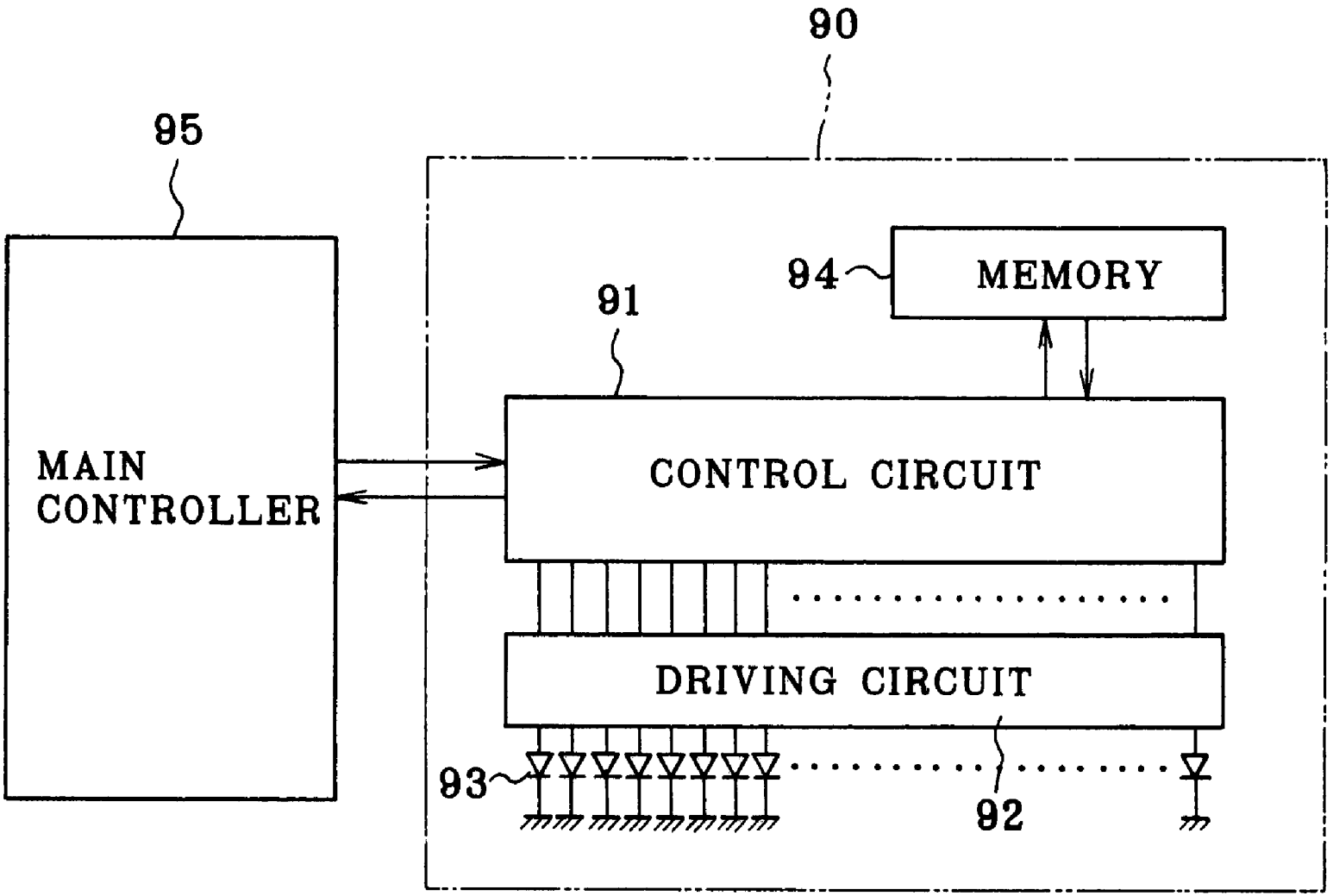
FIG. 7 is a block diagram showing the schematic structure of a control unit.

FIG. 7 is a block diagram showing an example of the control mechanism for controlling the organic EL elements of the present invention. In FIG. 7, numeral 95 designates a main controller of the image forming apparatus, and 90 designates a control unit for line head. In the control unit 90, a control circuit 91, a driving circuit 92, light emitting elements 93 using the organic EL elements, and a memory 94 are installed. The main controller 95 produces image data and transmits the image data to the control circuit 91. The control circuit 91 produces control signals according to the amounts of emitted light of the respective light emitting elements 93 and gives the control signals to the driving circuit 92 composed of TFTs (Thin Film Transistors). Stored in the memory 94 are the amounts of emitted light of the respective light emitting elements.

The driving circuit 92 functions as a direct current voltage applying means for applying direct current voltages to the organic EL elements. The control circuit 90 functions as a control means for controlling the driving circuit 92 to apply the direct current voltages higher than "0" and lower than the threshold voltage to the organic EL elements during non-printing as mentioned above. Since the respective amounts of emitted light for the respective light emitting elements are stored in the memory 94, the amount of emitted light can be controlled for each of the selected light emitting elements. The aforementioned memory 94 may be set to the body of the image forming apparatus. This case has an advantage of reducing the size of the line head.

Figure 8:
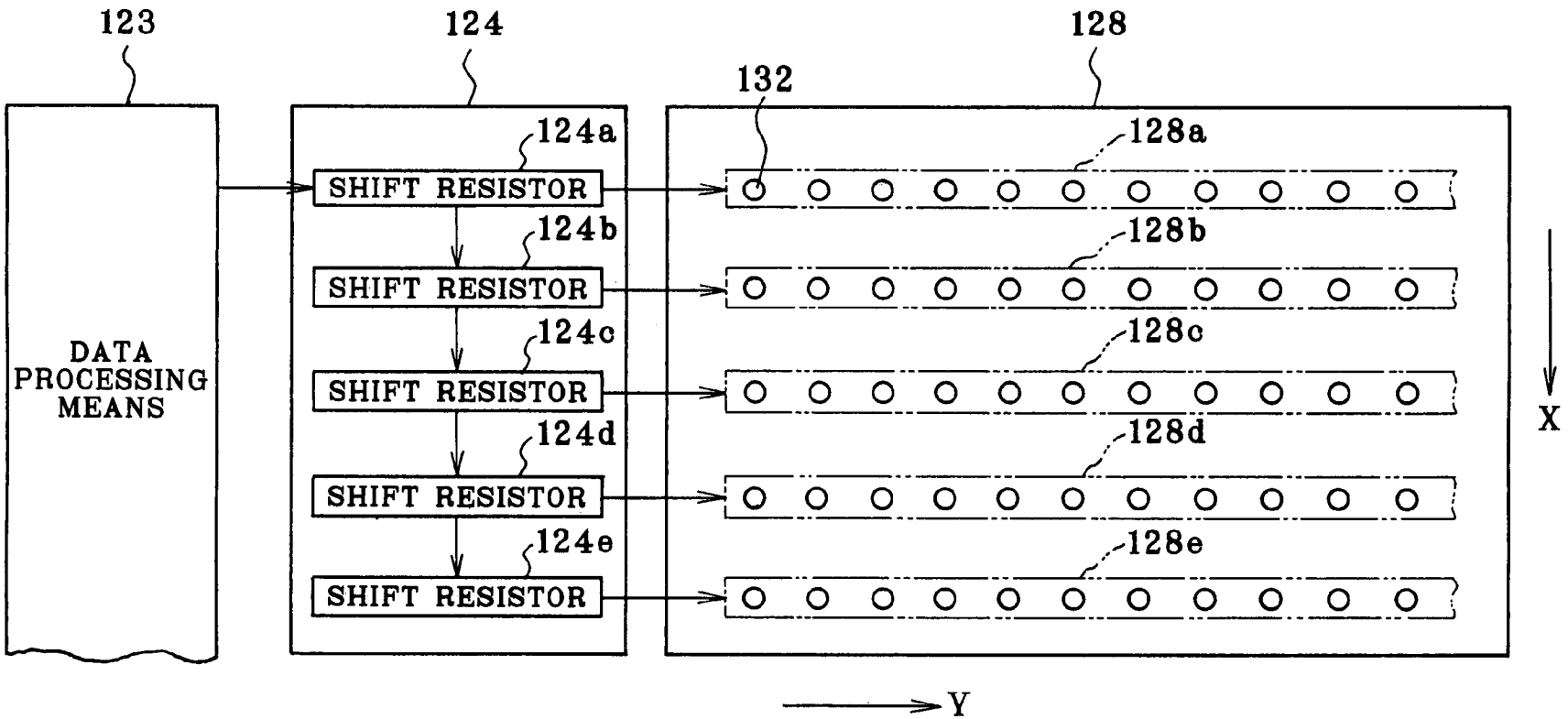
FIG. 8 is a block diagram showing an example employing shift resistors.

FIG. 8 is a block diagram showing an example for conducting multiple exposure. In FIG. 8 a data processing means 123 is provided in the control circuit shown in FIG. 7 and a storage means 124 is provided in the driving circuit shown in FIG. 7. Shown in FIG. 8 are the light-emitting element (yellow) line head 128 and details of the storage means 124 corresponding to the line head 128. The line head 128 includes a line 128*a* provided with a plurality of light-emitting elements 32. In this example, five lines 128*a*-128*e* are arranged in the sub scanning direction X of an image carrier and each line has the same number of light-emitting elements. That is, the line head 128 is a line head having a two-dimensional structure comprising a plurality of light emitting element lines, each provided with a plurality of orqanic EL elements, arranged in the sub scanning direction. The storage means 124 comprise shift resistors 124*a*-124*e* to correspond to the lines 128*a*-128*e* composed of the light-emitting elements, respectively. In FIG. 8, the direction of arrow X indicates the moving direction (sub scanning direction) of a photo sensitive drum (image carrier) and the direction of arrow Y indicates the main scanning direction.

Now, the operation of the block diagram shown in FIG. 8 will be described. As the image data is inputted from the data processor 123 into the storage means 124, the shift resistor 124*a* outputs image data to the light emitting elements in the first line 128*a* so that the light emitting elements work, whereby pixels on the image carrier are exposed to a predetermined amount of light. The image carrier is driven to rotate in the direction of arrow X in such a manner that the pixels exposed by the light emitting elements of the first line 128*a* reach a position corresponding to the light emitting elements arranged in the next line 128*b*. At the same time, the image data inputted in the shift resistor 124*a* are transmitted to the shift resistor 124*b*.

The shift resistor 124*b* outputs the image data to the light emitting elements of the line 128*b* so that the light emitting elements work. Accordingly, the pixels previously exposed by the light emitting elements of the line 128*a* are exposed again by the light emitting elements of the line 128*b* with the equal amount of light. In this manner, the image data is sequentially transmitted from the previous shift resistor to the next shift resistor while the image carrier is moved in the direction of arrow X, whereby each same pixel is exposed again and again by light emitting elements in different lines. Consequently, in the example of FIG. 8, the respective pixels are exposed to light of which amount is quintuple of that of a single light emitting element, thereby quickly obtaining the amount of light required to expose each pixel. The number of the lines in which the light emitting elements are aligned in the sub scanning direction can be suitably selected, that is, the number for multiplying the amount of light for exposure to be obtained by a single light emitting element can be suitably selected, if necessary.

In the present invention, once the data processing means 123 of the image forming apparatus produces data only for one line, the image data for the first line is stored in the storage means (shift resistor) and are transmitted among the storage means, whereby the operations of all light emitting elements of the line head can be controlled. Since the data processing means is not required to produce data for all light emitting elements of the line head, the structure of circuit can be simplified and the data processing can be conducted at high speed.

In the embodiment employing the structure shown in FIG. 8 of the present invention, image data outputted from the data processing means may be composed as follows. That is, the image data for at least one line are set to be such a value higher than 0V and lower than the threshold voltage as not to form an image on the image carrier as discussed with regard to FIG. 5. As the organic EL elements aligned in one light emitting element line are actuated by the direct current voltage, the light emitting element line functions as a heater for increasing the temperature. Therefore, the light emitting element line functions as a dummy line which does not form an image.

In the example of FIG. 8, at least one of the organic EL elements may be selected from each of the light emitting element lines, as elements to which the aforementioned direct current voltage higher than 0V and lower than the threshold voltage is applied. In this case, five organic EL elements for forming an image of the same dot on the image carrier are arranged in the sub scanning direction so that the same dot is exposed to light repeatedly five times. Therefore, only ⅕ of the voltage "Va" is enough as the voltage to be applied to the organic EL element during non-printing, thereby reducing the allocation of voltage on the organic EL elements and thus lengthening the lives of the organic EL elements. It should be noted that the line head using the organic EL elements to which the present invention is adopted can be composed of only a single light emitting element line shown in FIG. 8, for example, the line 128*a*. In this case, a line head having a simple structure can be obtained.

In the embodiment employing the structure shown in FIG. 8 of the present invention, image data outputted from the data processing means may be composed as follows. That is, the image data for at least one line are set to be such a value higher than the threshold voltage as discussed with regard to FIG. 6. As the organic EL elements aligned in one light emitting element line are actuated by the direct current voltage, the light emitting element line functions as a heater for increasing the temperature. Therefore, the light emitting element line functions as a dummy line which does not form an image. In the multiple exposure, no toner image is formed by lighting the elements on one line. Accordingly, the magnitude of the direct current voltage to be applied to the aforementioned organic EL elements may be equal to or higher than that of the direct current voltage to be applied during printing.

In the example of FIG. 8, at least one of the organic EL elements may be selected from each of the light emitting element lines, as the element to which the aforementioned direct current voltage higher than the threshold voltage is applied. In this case, five organic EL elements for forming an image of the same dot on the image carrier are arranged in the sub scanning direction so that the same dot is exposed to light repeatedly five times. Therefore, the voltage to be applied to the organic EL element during non-printing can be further lower than the voltage "Va" of FIG. 6, thereby reducing the allocation of voltage on the organic EL elements. It should be noted that the line head using the organic EL elements to which the present invention is adopted can be composed of only a single light emitting element line shown in FIG. 8, for example, the line 128*a*. In this case, a line head having a simple structure can be obtained.

FIG. 9 is a table for explanation of a data example for voltages to be applied to the aforementioned organic EL elements according to the intensity modulating control. In the example of FIG. 9, the magnitudes of the voltages are represented by gradation data and the gradation data are stored in gradation data memories. In FIG. 9, a table in which bit data numbers, bit data, and gradation data are put to correspond to each other is shown. The bit data No. 1 is a gradation data 0 (the minimum value), the bit data No. 8 is a gradation data 255 which is the maximum value among voltages to be applied during printing, and the bit data No. 2-No. 7 are data for neutral densities therebetween (the middle therebetween).

Figure 10:
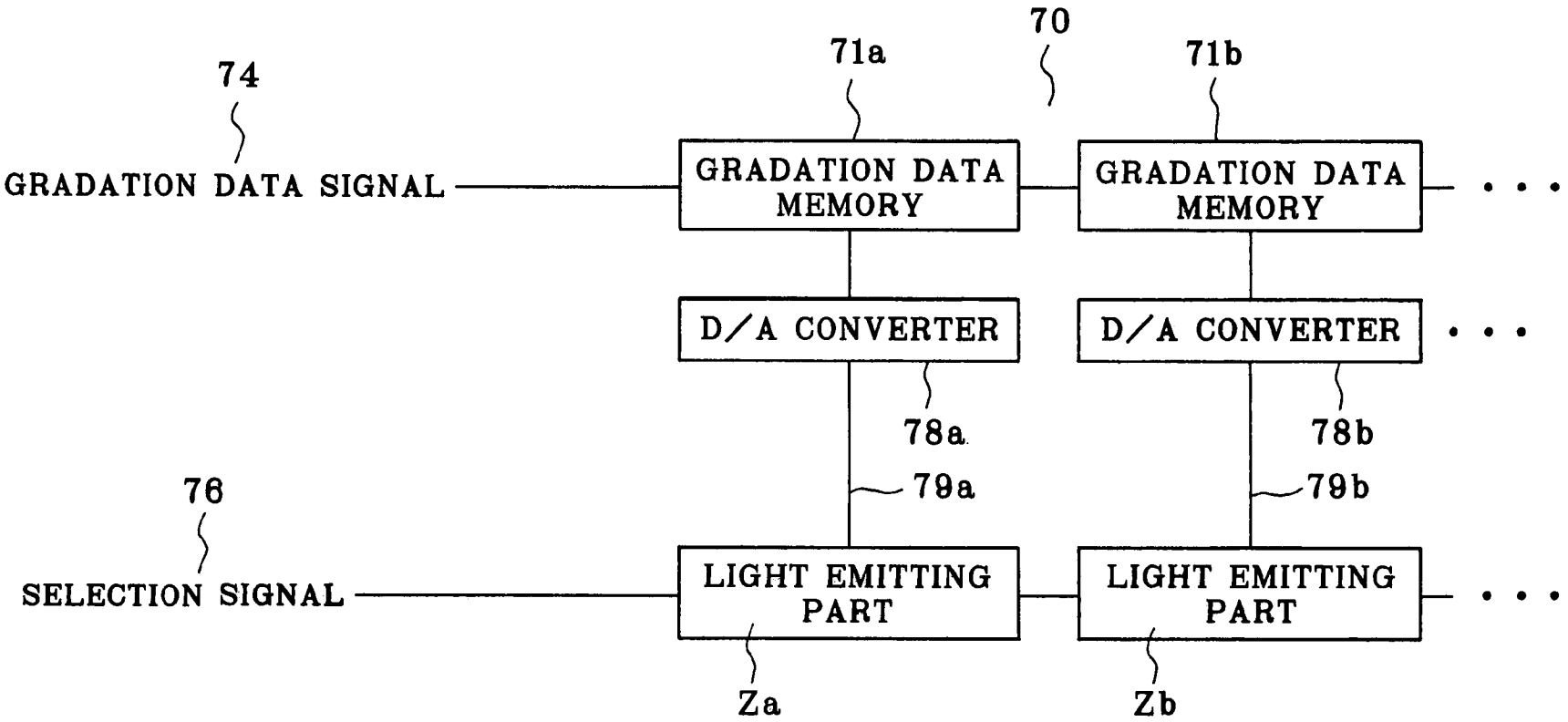
FIG. 10 is a block diagram showing the intensity modulating control.

FIG. 10 is a block diagram showing an example in which the voltages to be applied to the organic EL elements of the present invention during non-printing are prepared according to the intensity modulation. The example shown in FIG. 10 controls the switching TFT with voltages or currents corresponding to the values of the gradation data. Such control as shown in FIG. 10 is called "Intensity Modulation Control" in the present invention. The control circuit 91 shown in FIG. 8 produces gradation data signals 74 and the selection signals 76.

In an intensity modulation control unit 70 shown in FIG. 10, D/A converters 78*a*, 78*b* . . . are connected to the gradation data memories 71*a*, 71*b* . . . , respectively. The D/A converters 78*a*, 78*b* form signals of analog voltage values or current values corresponding to the sizes of the gradation data stored in the gradation data memories 71*a*, 71*b* . . . . The signals are outputted to the switching TFTs of the light emitting parts Za, Zb . . . selected by the selection signal 76 through the signal lines 79*a*, 79*b* . . . .

In the example of FIG. 10, the amounts of lights emitted from the light emitting elements are changed by changing the biases of the switching TFTs according to the gradation data. Therefore, it is not required to control the ON/OFF of the light emitting elements at a high speed. Even when the speed of response of the light emitting elements is low, this control can be adopted and the amount of exposure to the image carrier can be changed at a high speed. In FIG. 10, for example, the three-bit gradation data is put to correspond to the threshold voltage. The voltage corresponding to the two-bit gradation data is applied to the organic EL elements during non-printing.

Figure 11:
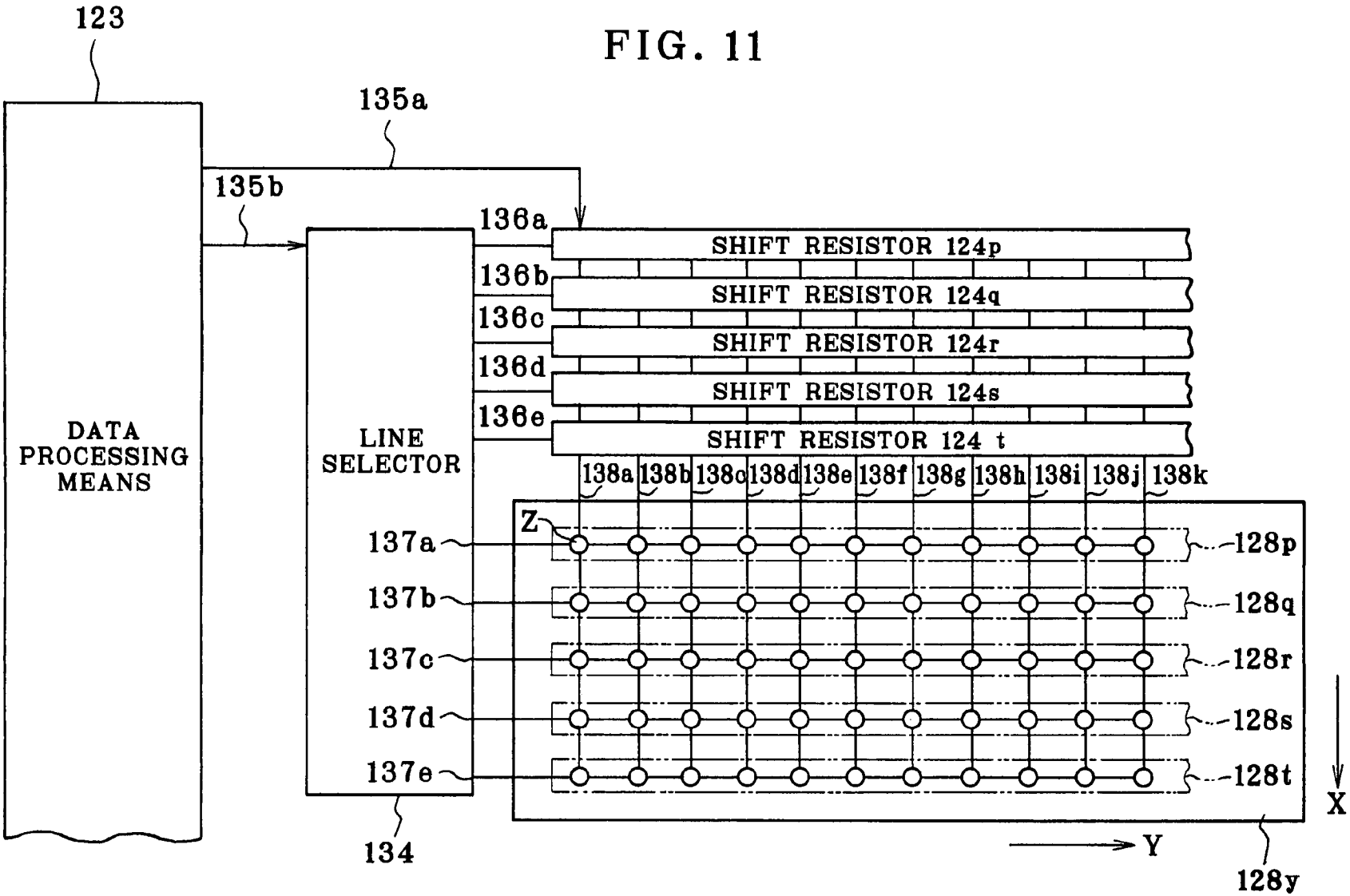
FIG. 11 is a block diagram showing another embodiment.

FIG. 11 is a block diagram showing an image forming apparatus according to another embodiment of the present invention. The example shown in FIG. 11 is an apparatus in which organic EL elements are driven in the active matrix method. In FIG. 11, "Z" indicates each single light emitting part composed of a light emitting element of the organic EL element and a driving circuit arranged according to the active matrix method. For example, arranged in a line head 128Y for yellow are five lines of light emitting elements 128*p*-128*t*. Corresponding to the respective light emitting element lines 128$p$-128$t$, shift resistors 124$p$-124$t$ are arranged. Connected to a data processing device 123 is a line selector 134. Numeral "135$a$" designates a supply line of image data from the data processing device 123 to the shift resistors, "135$b$" designates a control line connecting the data processing device 123 and the line selector 134, "136$a$-136$e$" designate command lines for commanding action from the line selector 134 to the respective shift resistors 124$p$-124$t$, "137$a$-137$e$" designate scanning lines for supplying signals from the line selector 134 to the light emitting elements of the respective lines, and "138$a$-138$k$" designate signal lines for supplying operational signals from the shift resistors 124$p$-124$t$ to respective lines i.e. individual light emitting elements (organic EL elements).

Description will now be made as regard to the operation of FIG. 11. According to a control signal supplied from the data processing device 123 through the control line 135$b$, the line selector 134 selects a scanning line 137$a$ and send a signal to light emitting element line 128$p$. In addition, the line selector 134 activates the shift resistor 124$p$ according to the signal through the command line 136$a$. The shift resistor 124$p$ activates the signal lines 138$a$-138$k$ to send output signals of image data to all of the light emitting elements in the light emitting element line 128$p$. The organic EL elements in the light emitting element line 128$p$ emit lights to expose pixels. By changing the scanning line 137 and the command line 136 according to the signal from the line selector 134, the above actions are also conducted for the light emitting element lines 128$q$, 128$r$, 128$s$, and 128$t$, whereby the light emitting elements in all lines are activated to emit light to expose the pixels. Then, the image data in the shift resistor 124$s$ is transmitted to the shift resistor 124$t$. In the same manner, the image data is sequentially transmitted from the shift resistor 124$r$ to the shift resistor 124$s$, from the shift resistor 124$q$ to the shift resistor 124$r$, and the shift resistor 124$p$ to the shift resistor 124$q$. To the shift resistor 124$p$, image data is transmitted from the data processing means 123 through the signal line 135$a$. During this, the image carrier is moved for the pixel pitch.

Since the light emitting elements at the light emitting parts Z remain to emit lights because of the function of the active matrix, the light emitting elements do not light out even during the transmission of image data between the shift resistors, thereby exposing pixels with high luminance. By repeating the outputting of image data from the shift resistor 124 to the light emitting elements, the transmission of the image data between the shift resistors, and the movement of the image carrier, thereby consecutively exposing the image data onto the image carrier. Therefore, in the example of FIG. 11, the respective pixels are exposed to light of which amount is quintuple of that of a single light emitting element, thereby quickly obtaining the amount of light required to expose each pixel. The number of the lines in which the light emitting elements are aligned in the sub scanning direction can be suitably selected, that is, the number for multiplying the amount of light for exposure to be obtained by a single light emitting element can be suitably selected, if necessary. By connecting the organic EL elements to the driving circuit of the active matrix method, the operation with low voltage can be kept so as to increase the temperature even when the switching transistor is OFF or when the data are transmitted between shift resistors.

Figure 12:
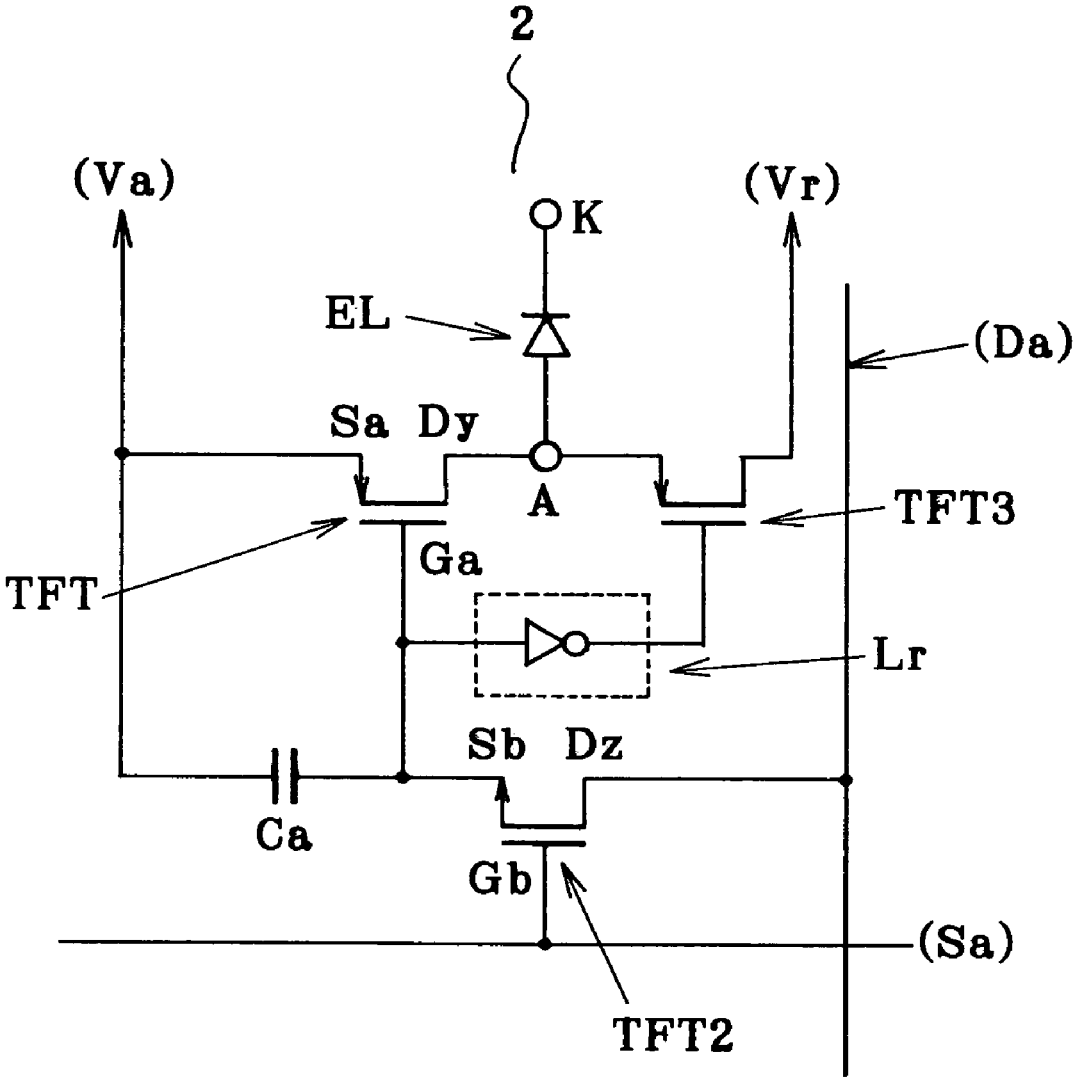
FIG. 12 is a circuit diagram showing a driving circuit for organic EL elements.

FIG. 12 is a circuit diagram for operating the light emitting parts Z according to the active matrix as shown in FIG. 11. In FIG. 12, an organic EL element is employed as each light emitting element, "K" designates a cathode terminal thereof and "A" designates an anode terminal. The cathode terminal K is connected to a power source which is not shown. Employed as the scanning line to which selection signal Ta is inputted is, for example, a scanning line 137$a$. A control signal Ua for selecting individual light emitting element(s) can be supplied from, for example, the signal line 138$a$ shown in FIG. 11. A selection signal Ta is supplied to a gate Gb of a switching TFT (Tr1).

The control signal Ua is spplied to a drain Da of the switching TFT. "Vx" designates a power line and "Ca" designates a storage capacitor. A source Sb of a driving TFT (Tr2) of the organic EL element is connected to the power line Vx and a drain Db is connected to the anode terminal A of the organic EL element. In addition, a gate Gb of the driving TFT (Tr2) is connected to a source Sa of the switching TFT (Tr1).

Description will now be made as regard to the operation of the circuit shown in FIG. 12. As the scanning line and the signal line are energized in a state that a voltage of the power line Vx is applied to the source of the switching TFT, the switching TFT (Tr1) is turn ON. Accordingly, the gate voltage of the driving TFT (Tr2) is lowered and the voltage of the power line Vx is supplied from the source of the driving TFT (Tr2) so that the driving TFT becomes to the conducting state. As a result, the organic EL element is activated to emit light of a predetermined amount. In addition, the storage capacitor Ca is charged by the voltage of the power line Va.

Even when the switching TFT (Tr1) is turned OFF, the driving TFT (Tr2) is still in the conducting state according to the charge stored in the storage capacitor Ca so that the organic EL element remains to emit light. Therefore, by adopting the active matrix to the driving circuit for the light emitting elements, the operation of the organic EL element is maintained to keep emitting light even when the switching TFT is turned OFF for transmitting the image data between the shift resistors, thereby exposing pixels with high luminance.

As mentioned above, in the driving circuit of the active matrix method, the light emitting state of the organic EL element can be kept by the condenser and the transistors provided around the organic EL element. Therefore, for conducting multiple recording by repeatedly exposing one pixel to light, the light emission can be kept even during the transmission of image data from the storage means to the storage means of the next line, thereby exposing pixels with high luminance. By suitably selecting the scanning line to which the selection signal Ta is supplied and the signal line to which the control signal Ua is supplied, one of the organic EL elements in each light emitting element line is selected such that the voltage control during non-printing can be conducted relative to the selected organic EL element. In this manner, the driving circuit of the active matrix method shown in FIG. 12 can control all of the organic EL elements of each line and also control individual organic EL element.

Therefore, when multiple exposure is conducted with a plurality of organic EL elements arranged two-dimensionally in the main scanning direction and the sub scanning direction by moving the image carrier in the sub scanning direction, the voltage control can be conducted relative to single organic EL element. That is, the temperature of the organic EL elements can be increased by sequentially applying a voltage higher than 0V and lower than the threshold voltage to the organic EL elements for forming an image of the same dot during non-printing.

Figure 13:
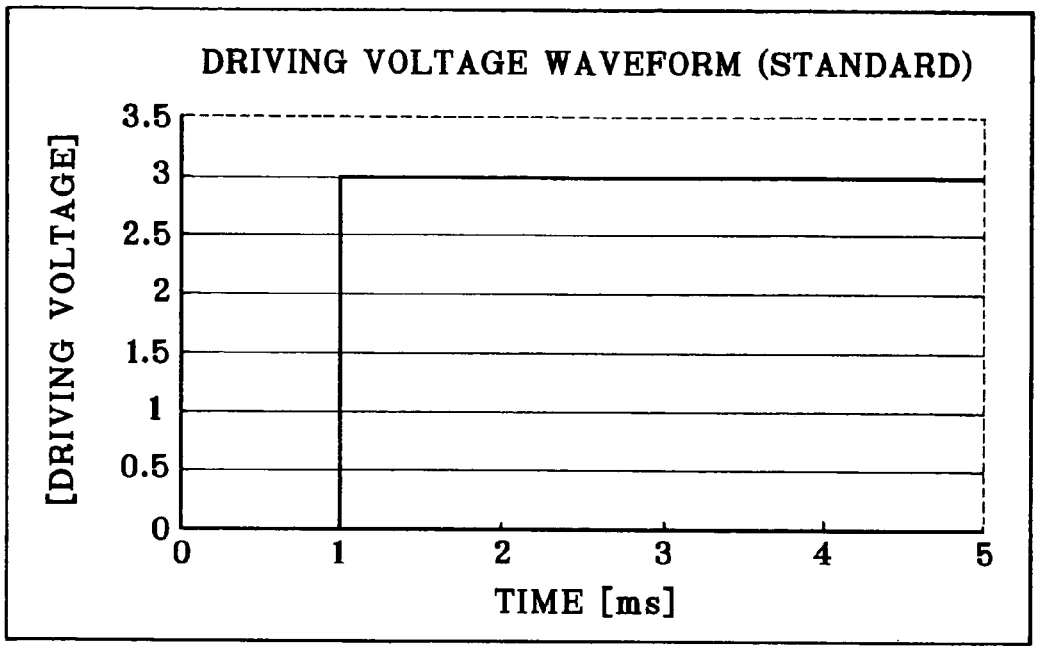
FIG. 13 is a characteristic graph showing a driving voltage waveform of the organic EL element.
Figure 14:
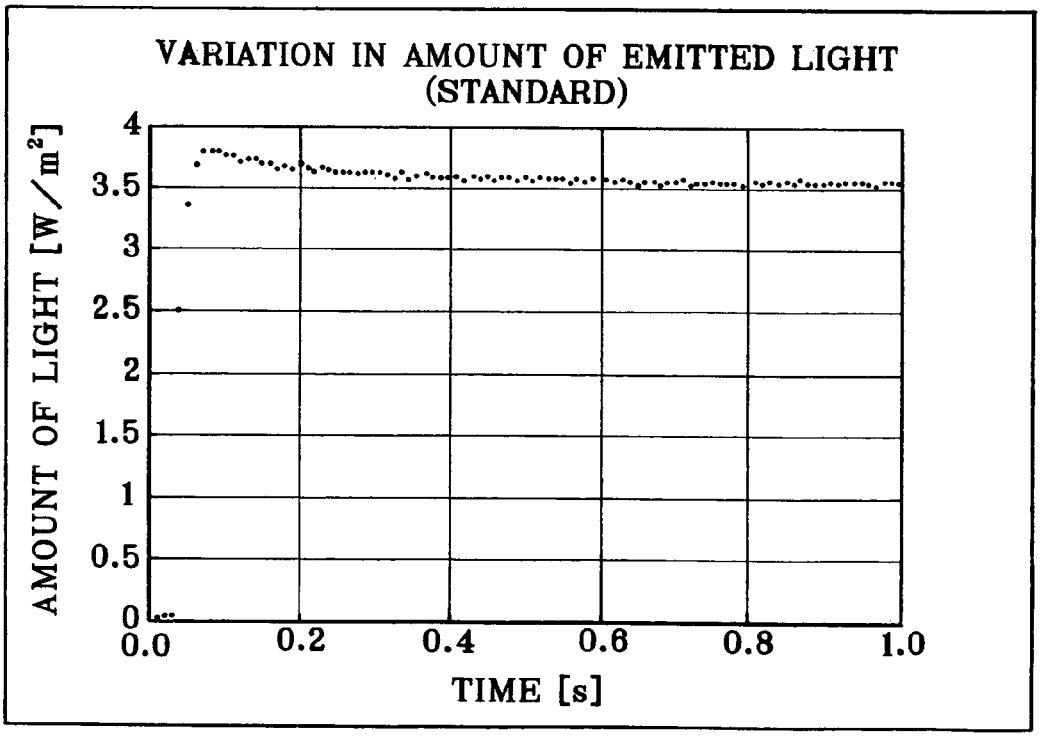
FIG. 14 is a characteristic graph showing variation in amount of emitted light corresponding to FIG. 13.

FIG. 13 is a characteristic graph showing the driving voltage waveform (standard) of the organic EL element. In FIG. 13, the axis of abscissa indicates the time (ms) and the axis of ordinate indicates the driving voltage (relative value). FIG. 14 is a characteristic graph showing the variation in amount of emitted light (standard) of the organic EL element corresponding to FIG. 13. In FIG. 14, the axis of abscissa indicates the time (s) and the axis of ordinate indicates the amount of light ($W/m^2$) after application of driving voltage. As shown in FIG. 13, the driving voltage wave form of the organic EL element has a diode characteristic. As shown in FIG. 14, the amount of emitted light of the organic EL element tends to be momentaneous high at the initial stage of light emission and be stable after that. As shown in FIG. 14, the amount of emitted light of the organic El element varies with time. The variation in amount of emitted light as mentioned above leads to a problem that the image density also varies, thus deteriorating the quality. In addition, since the light emitting efficiency of the organic EL element is low, it is required to apply high voltage for forming a latent image. However, as the voltage is increased, the life of the organic EL element is shortened. This is also a problem.

Figure 15:
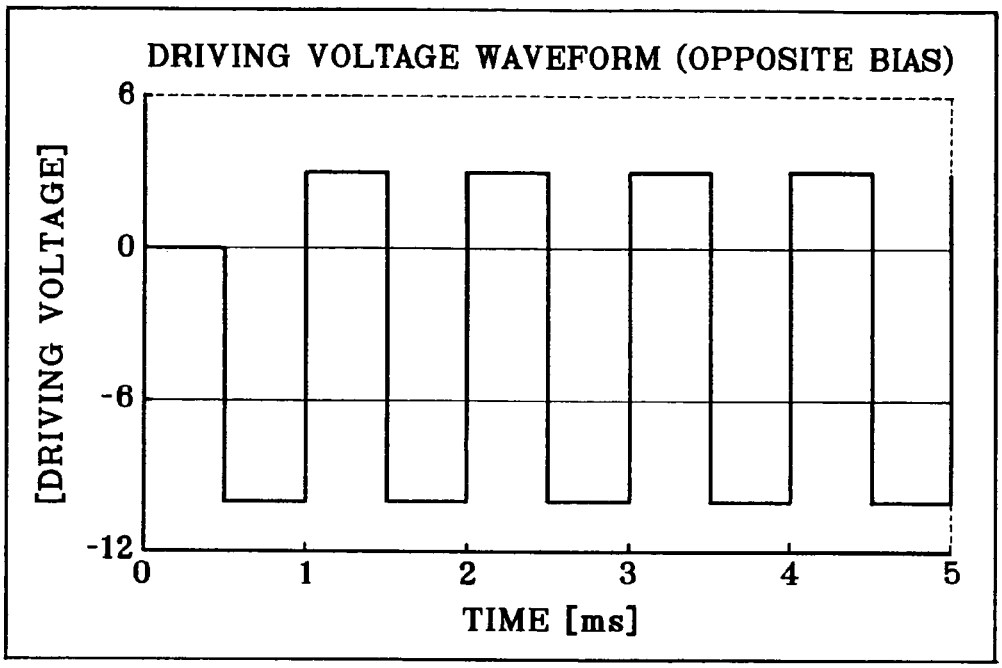
FIG. 15 is a characteristic graph showing a driving voltage waveform according to the present invention.

An embodiment of the present invention for solving the aforementioned problems will be described. FIG. 15 is a characteristic graph showing the driving voltage waveform of the organic EL element according to this embodiment of the present invention. Similarly to FIG. 5, the axis of abscissa indicates the time (ms) and the axis of ordinate indicates the driving voltage. The present invention is characterized in that voltage of bias polarity opposite to the bias polarity of voltage of making the organic EL element to emit light is applied. Though the organic EL element emits light when a direct current voltage is applied as mentioned above, the organic EL element does not emit light when a voltage (voltage of opposite bias polarity) of the polarity opposite to the polarity of the direct current voltage for light emission.

In the example shown in FIG. 15, pulses of the voltage of opposite bias polarity and the voltage of bias polarity of making the organic EL element to emit light (forward voltage of emission polarity) are alternatively applied. As the voltage of opposite bias polarity is applied, residual carriers of the light emitting layer are moved as will be described later. Therefore, no residual carrier exists when the organic EL element emits light, thereby obtaining stable amount of light.

The absolute value of the applied voltage of the opposite bias polarity is set to be larger than the absolute value of the forward voltage. Accordingly, the residual carriers can be moved from the light emitting layer at a higher speed than the moving speed of the carrier when light is emitted. In addition, the value obtained by multiplying the applied voltage by the application time, i.e. the magnitude of voltage application energy, in the application of voltage of opposite bias is larger than that in the application of forward voltage. Accordingly, the residual carriers can be quickly removed from the light emitting layer.

Figure 16:
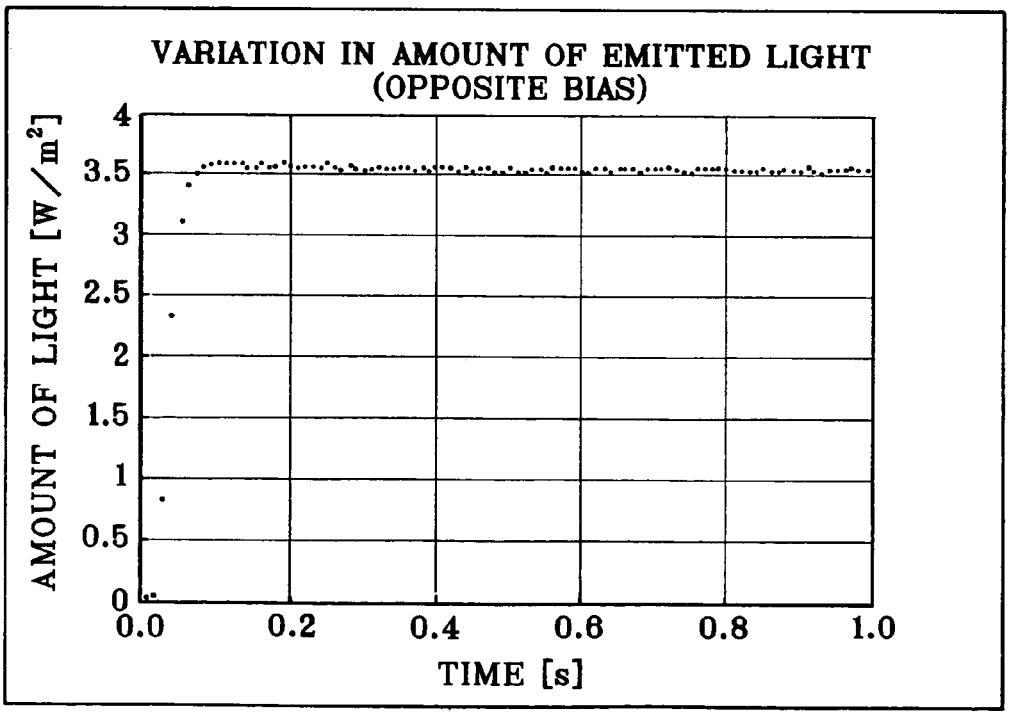
FIG. 16 is a characteristic graph showing variation in amount of emitted light corresponding to FIG. 15.

FIG. 16 is a characteristic graph showing the variation in amount of emitted light in case that voltage of opposite bias polarity is applied to the organic EL element as shown in FIG. 15. Similarly to FIG. 14, the axis of abscissa indicates the time (s) and the axis of ordinate indicates the amount of light ($W/m^2$) after application of driving voltage. As shown in FIG. 16, the variation in amount of emitted light is repressed in the present invention, thereby obtaining a flat characteristic of the amount of light with time. Therefore, stable amount of light can be obtained.

Figure 17:
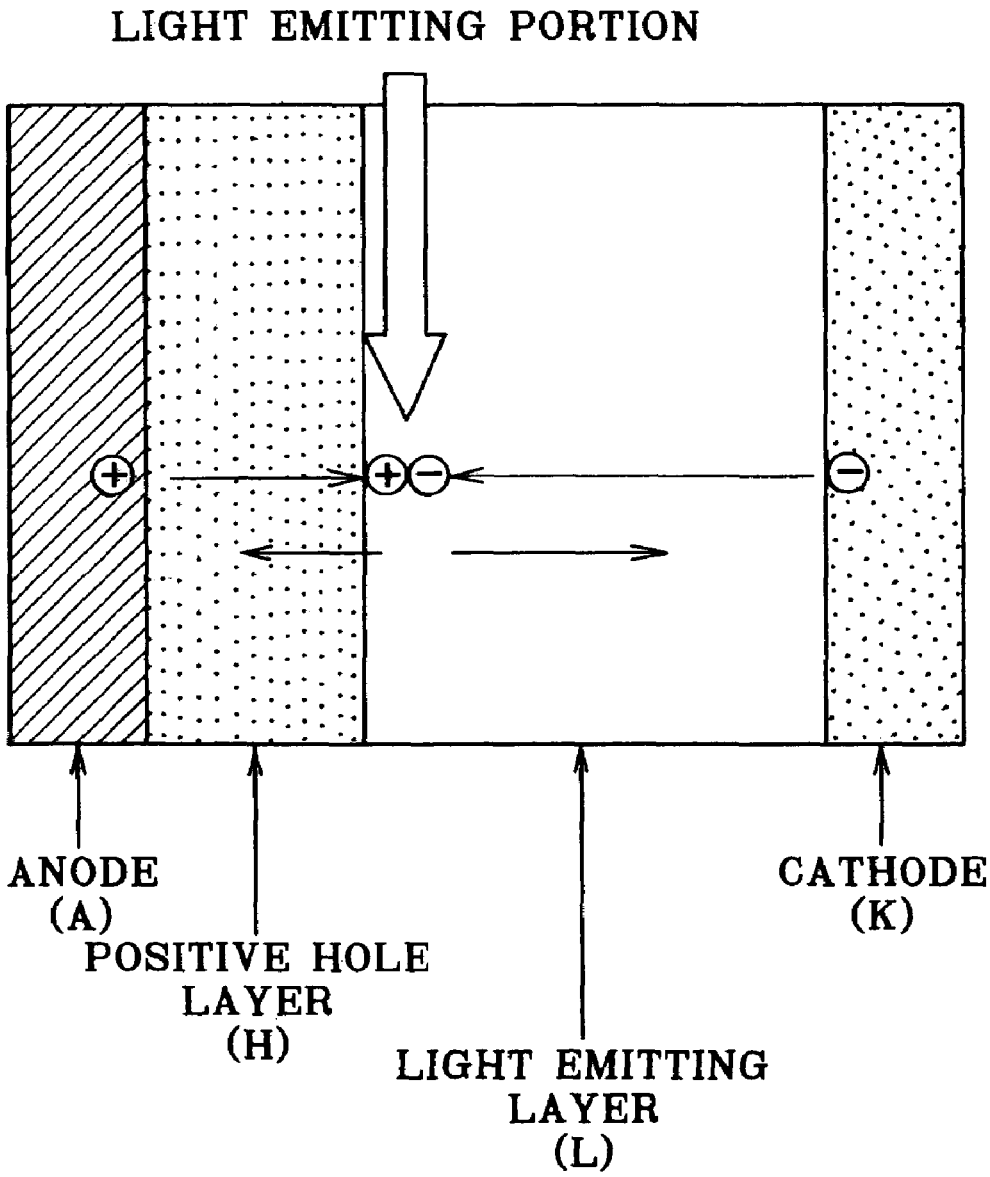
FIG. 17 is an explanatory view schematically showing the works of the organic EL element.

FIG. 17 is an explanatory view schematically showing the structure of the organic EL element. In FIG. 17, as a forward voltage is applied to the anode (A) and cathode (K), positive holes (+) of the positive hole layer (H) are moved to the light emitting layer (L). In addition, electrons (−) of the cathode (K) are moved to the light emitting layer (L) so that the positive holes (+) and the electrons (−) are recombined in the light emitting layer (L). During this, the energy of free electrons (−) are emitted as light. Generally, the organic EL material has such a characteristic that the moving speed of carrier is low. Since the light emitting range of the EL (the range in which the electrons and the positive holes are recombined) is so small, the organic EL material has such a characteristic that the falling speed of level from the exciton energy level to the reference level is fast, that is, the lives of exciters are short. Though the response of emitted light relative to the applied pulses is high, the residual amount of carriers in the organic EL element when the applied pulse is applied varies depending on the number of pulses and the magnitude of the applied voltage.

Accordingly, when the pulses are continuously applied to the organic EL element, the amount of emitted light varies. However, when a voltage of the polarity opposite to the emission polarity is applied to the organic EL element, the organic EL element does not emit light. In FIG. 17, the positive holes (+) and electrons (−) remaining in the light emitting layer (L) are returned to the original positions so that residual carriers are removed from the light emitting layer (L). Therefore, as a forward voltage is applied to the organic EL element next time, the condition of the inside of the organic EL element is always constant, thereby obtaining stable amount of light. In addition, the amount of light is increased. Further, lower voltage is enough as the voltage applied to the organic EL element, thereby preventing the deterioration of the organic EL element. In the present invention, for driving the organic EL element, first the voltage of opposite bias polarity is applied and then the forward voltage is applied to make the organic EL element to emit light as shown in FIG. 15 and FIG. 16. According to this, momentaneous variation in amount of emitted light at the start can be prevented.

As mentioned above, in the present invention, a voltage of opposite bias polarity is applied to the organic EL element. Accordingly, residual carriers inside the organic EL element are removed from the light emitting layer, thereby obtaining stable amount of light. In addition, the amount of emitted light can be increased so that lower voltage to be applied to the organic EL element is allowed, thereby preventing the deterioration of the organic EL element. When the organic EL elements in which the aforementioned control is conducted are provided in a line head to form an image, an image forming apparatus without variation in amount of emitted light of the image writing means and without variation in image quality can be obtained.

Figure 18:
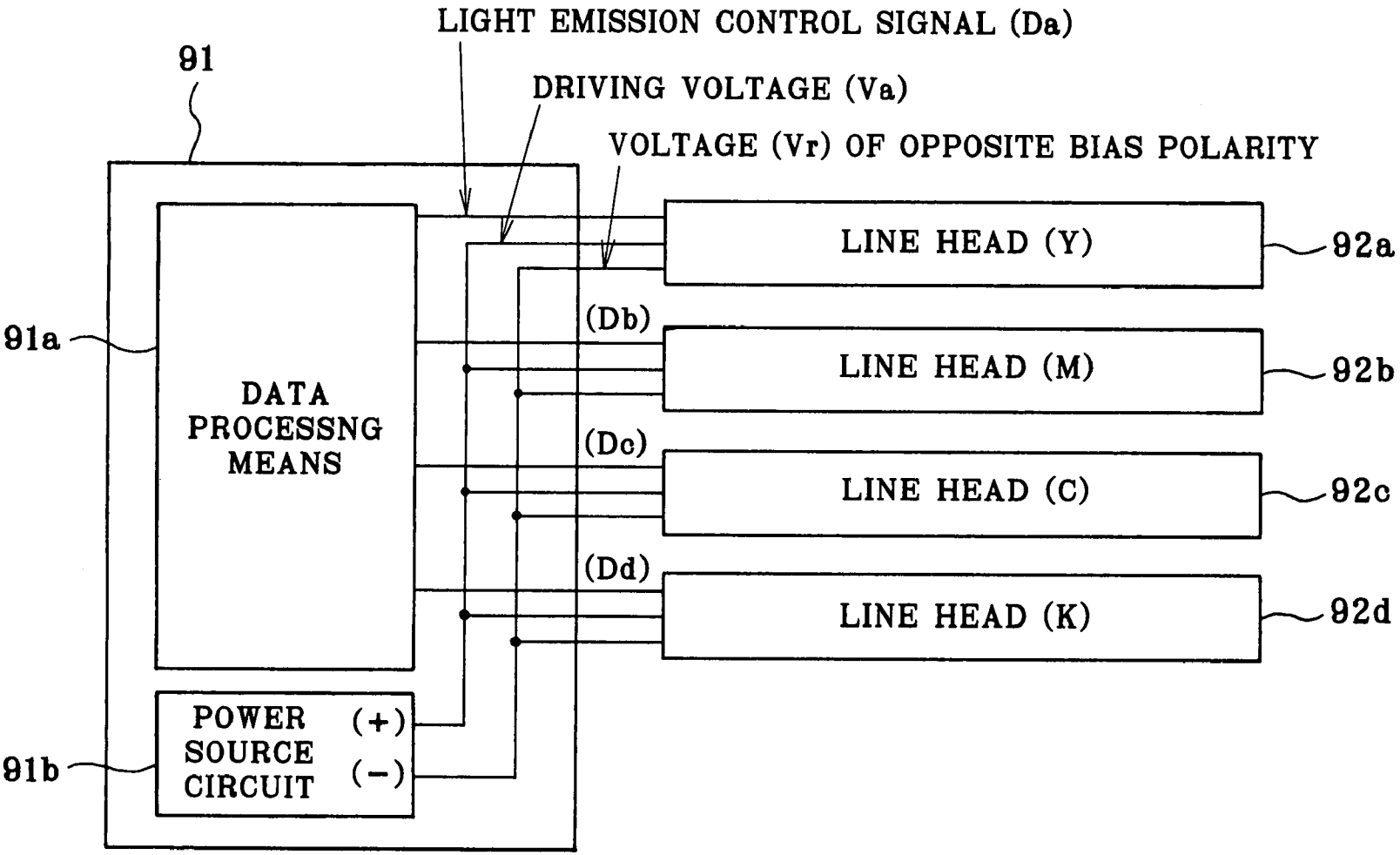
FIG. 18 is a block diagram showing an example of a control circuit.

FIG. 18 is a block diagram showing an example of a control circuit according to another embodiment of the present invention. In FIG. 18, a control circuit 91 has a data processing means 91*a* and a power source circuit 91*b*. The data processing means 91*a* performs the color separation, the gradation treatment, the bit-mapping of image data, and the compensation of color registration error according to the print data transmitted from the main controller 95. Line heads 92*a*-92*d* correspond to yellow (Y), magenta (M), cyan (C), and black (K) and form unicolor images on the photoreceptor, respectively. Each of the line heads 92*a*-92*d* is composed of organic EL elements aligned in plural lines arranged in the sub scanning direction of the image carrier and is structured to allow the multiple exposure whereby the same pixel can be repeatedly exposed to light. The data processing means 91*a* produces light emission control signals Da-Dd for the organic EL elements and then sends the signals to the line heads 92*a*-92*d*. The power source circuit 91*b* applies a driving voltage (Va) of the emission polarity and a voltage (Vr) of the opposite bias polarity to the organic EL elements.

By the way, in the electrophotography, the process conditions are changed depending on the variation in environment and the number of paper sheets to be printed. As a result, the density of the output image should vary. For this, the image density adjustment, that is, the patch control is conducted periodically. The patch control is conducted by forming images onto a latent image carrier or an image carrier to have different densities with changing the process conditions such as the charging bias and the development bias, and measuring the densities by means of an optical sensor. Based on the measured densities, the process condition is determined to have a constant density. Patch patterns are formed at a position corresponding to the position of the optical sensor.

However, the publications relating to the image forming apparatus employing the EL elements as the conventional examples do not disclose any operation during the patch control. In the conventional control of the EL elements, a voltage which is set to have such intensity as to produce afterglow even in non-image region where normally no latent image is formed is applied, Therefore, the conventional control has a problem that the lives of the EL elements are shortened. In addition, as the amount of light of the organic EL head varies during the formation of patch patterns as mentioned above, the density is changed due to the variation in amount of light so that it is difficult to print with constant image density even when the density adjustment is conducted. For example, depending on whether the group of organic EL element to be used for the formation of patch patterns is frequently used or not used before the patch control, the amount of light during the patch control differs. Therefore, there is a problem that the process control can not be conducted with high precision.

Figure 19:
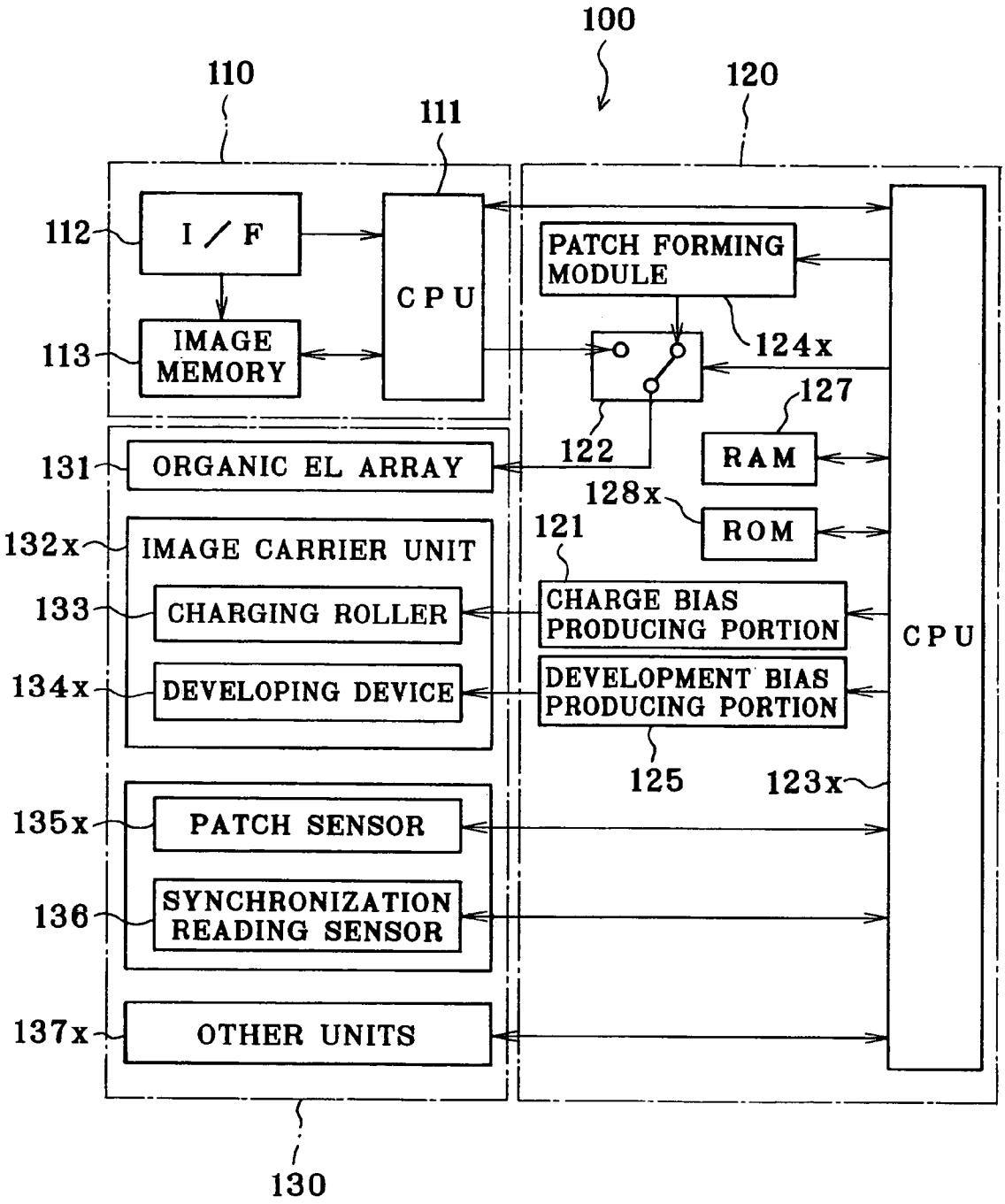
FIG. 19 is a block diagram showing an example of control unit.

Now, another embodiment of the present invention for solving such problems will be described. FIG. 19 is a block diagram showing an example of control unit which detects the density of patch image and adjusts the density of the toner images to a target density according to these detected image densities. In FIG. 19, a control unit 100 comprises a main controller 110, an engine controller 120, and an engine unit 130. Arranged in the main controller 110 are a CPU 111, an interface 112, and an image memory 113. The interface 112 is connected to an external device such as a host computer. The image memory 113 stores images transmitted from the external device such as a host computer through the interface 112.

As an image signal is transmitted from the external device such as a host computer to the main controller 110, the engine controller 120 controls the respective components of the engine unit 130 according to a command from the main controller 110 so as to form an image. Arranged in the engine controller 120 are a charge bias producing portion 121, an image signal switching portion 122, a CPU 123*x*, a patch forming module 124*x*, a development bias producing portion 125, a RAM 127, and a ROM 128*x*. The RAM 127 temporarily stores control data for controlling the engine unit 130 and results computed out by the CPU 123*x*. The ROM 128*x* temporarily stores computing programs to be conducted by the CPU 123*x*.

Arranged in the engine unit 130 are an organic EL array 131 as an image writing means, an image carrier unit 132 having a charging roller 133 and a developing device 134*x*, a patch sensor 135*x*, a synchronization reading sensor 136, and other units 137*x*. The organic EL array 131 of the engine unit 130 is connected to the image signal switching portion 122 so that a patch image signal outputted form the patch forming module 124*x* is given to the organic EL array 131 to form a patch latent image when the image signal switching portion 122 is in communication with the patch forming module 124*x* according to a command from the CPU 123*x* of the engine controller 120.

When the image signal switching portion 122 is in communication with the main controller 110, the emitted lights from the organic EL elements are scanned and exposed onto the photoreceptor according to an image signal transmitted from the external device such as a host computer through the interface 112, thereby forming an electrostatic latent image corresponding to the image signal. The density of the patch image is adjusted according to a signal from the charge bias producing portion 121 or the development bias producing portion 125. In the adjustment of the density of the patch image, the target density which is previously set and the density of the patch image detected by the patch sensor 135*x* are compared to each other and the charge bias or the development bias is reset to compensate an error relative to the target density. In this manner, the engine controller 120 functions as a density control means for patch images.

Figures 20A, 20B, 20C, 20D, 20E:
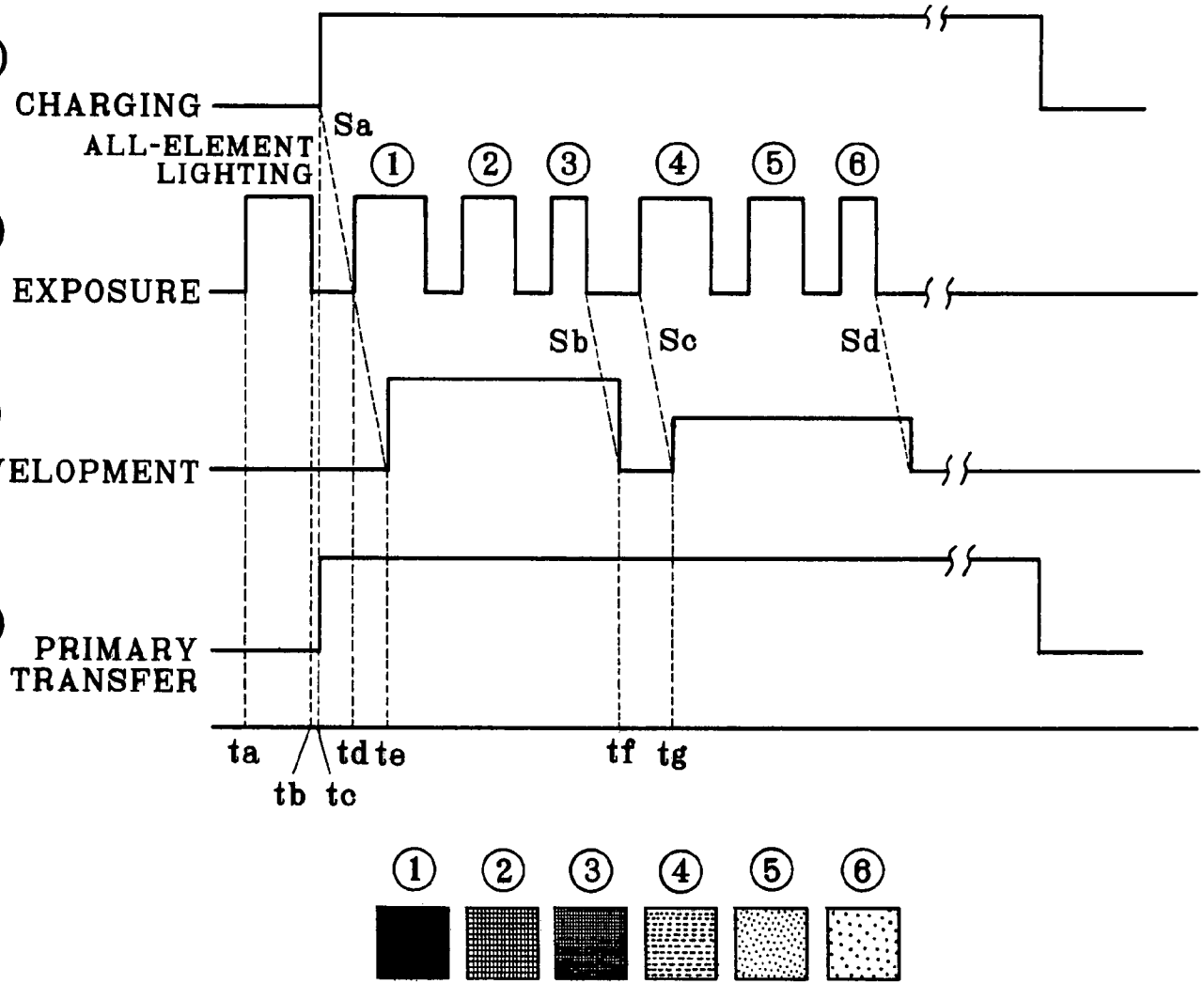
FIGS. 20A-20E are time charts as an example.

FIG. 20 is a time chart showing characteristics of the present invention. In FIG. 20, (a) indicates a charge bias characteristic, (b) indicates an exposure characteristic, (c) indicates a development bias characteristic, and (d) indicates a primary transfer characteristic. The high level of each characteristic indicates its operational state. In addition, (e) indicates patch patterns. A plurality of organic EL elements are aligned in each line. A plurality of the lines are aligned in the sub scanning direction. First, at least organic EL elements in a group disposed corresponding to a region where a patch pattern is formed on the image carrier are all lighted in a time period from time "ta" to time "tb" before the formation of the patch. In the following embodiment, the organic EL elements in a group mean organic EL elements in a column aligned in the sub scanning direction which form a latent image of the same dot of the image carrier. However, the organic EL elements in a group may be organic EL elements in a group adjacent to each other on the same line. After the operation of lighting all of the organic EL elements in the group, a charge bias is applied to the photoreceptor at time "tc". Then, patch patterns (1)-(6) of which densities are different in stages are formed on the charged photo receptor by changing the driving pulse length of the organic EL elements from time "td". The patch patterns are formed variously according to the pulse lengths of the organic EL elements as shown in (e).

To form toner images, a development bias is applied to the portions where latent images are formed from time "te" to time "tf". A time period from time "tf" to time "tg" is a pause in development bias application. Patch patterns (4)-(6) are formed by changing the level of the development bias from time "tg". The image densities of the patch patterns are measured. In this manner, the patch patterns (1)-(6) are formed. According to this, the optimum development bias is determined. Application of primary transfer bias is started at time "tc" similarly to the start time of the application of a charge bias. As shown in FIG. 20, the amounts of lights of the organic EL elements during formation of the patch patterns become equal by lighting all of the organic EL elements in the group before the formation of the patch patterns, thereby making the image densities constant. The lighting of all of the organic EL elements in group for forming patch images is conducted only before the formation of patch patterns. Therefore, the deterioration of the organic EL elements can be reduced. This example is structured such that at least organic EL elements in a group for forming patch images are controlled to be all lighted before the formation of patch patterns. According to the present invention, it can be structured such that organic EL elements of group are controlled to be all lighted ("all-element lighting") before the formation of patch patterns. In this case, the entire organic EL elements are stabilized, thereby reducing variation in amount of lights after the formation of patch images.

In FIG. 20, broken lines "Sa"-"Sd" connecting the charge bias characteristic (a), the exposure characteristic (b), and the development bias characteristic (c) indicate conditions that the aforementioned processes (a)-(c) proceed at preset speeds. That is, there are declinations among the respective processes for proceeding time. In another embodiment of the present invention, the all-element lighting of the organic EL elements in group may be conducted additionally in the pause in development bias application from time "tf" and time "tg" in which the application of development bias rest. As shown in FIG. 20, the pause in exposure between exposure periods (3) and (4) is connected to the development characteristic (c) by the broken lines "Sb" and "Sc". The pause in development bias application is set to be shifted from the pause in exposure. This case has an advantage that the amounts of lights are stabilized because the frequency of all-element lighting of the organic EL elements in the group becomes higher.

In FIG. 20, suitable development biases are determined such that the level of the development bias during a time period from time "te" to time "tf" is different from that after time "tg" while the charge bias is constant. In the present invention, the development bias may be set to be constant during the formation of patch pattern while the charge bias may be changed to determine suitable charge bias. In FIG. 20, the all-element lighting of the organic EL elements in group is conducted before the application of charge bias to the photoreceptor. Accordingly, no latent image is formed on the photoreceptor even though the organic EL elements in group are all lighted, thereby preventing the generation of memories on the photoreceptor. In FIG. 20, the all-element lighting of the organic EL elements in group is conducted before the application of development bias. Accordingly, since no toner image is formed on the photoreceptor even though the organic EL elements in the group are all lighted, thereby preventing wasteful consumption of toner.

As shown in FIG. 20, the order in which the patch patterns are formed is an order from (1)-(6), that is, from the highest density to the lowest density, in consideration of the level of development bias and the actual pulse length to the organic EL elements. The higher the density is, the organic EL elements are exposed to larger amount of light so that stable light emission can be obtained in a short amount of time. The sensor sensibility of the patch sensor is lowered as the density is lower. Since the control for the patch pattern with higher density is preceded, the organic EL elements can be stabilized even if the sensor sensibility is lowered during the formation of pattern with low density. Therefore, the density of image can be uniformed. The all-element lighting control of the light the organic EL elements is not necessary when the patch patterns are formed in the order from the highest density. Though there is much point in forming the patch patterns in the order from the highest density, the all-element lighting of the organic EL elements in group to be employed together exhibits the multiplier effects. That is, the stabilization of light emission of the organic EL elements in group can be achieved in a short amount of time and the image densities can be uniformed. The all-element lighting control of the organic EL elements in group before the application of charge bias, the all-element lighting control before the application of development bias, the all-element lighting control at pauses in application of development bias may be employed with the control in which the patch patterns are formed in the order from the highest density.

Japanese Patent No. 2534364 discloses that an auxiliary pulse having such intensity as to produce afterglow is applied to EL elements corresponding to printing portions. However, since EL elements corresponding to non-printing portions, temperature difference is produced in the EL elements. Organic EL element has a characteristic that the amount of emitted light varies due to temperature change.

That is, in case of using organic EL elements as the light emitting elements, the amount of emitted light is increased when a voltage is applied so as to increase the temperature. In other words, as the temperature of the organic EL element varies, the amount of emitted light also varies. Consequently, In case that there are organic EL elements which emit light and organic EL elements which do not emit light, there is a problem that variation in light emission is generated due to variation in temperature among the elements. In addition, the deterioration of the organic EL element is accelerated by light emission. In case that there are organic EL elements which emit light and organic EL elements which do not emit light, there is a problem that variation in amount of emitted light is generated due to variation in level of deterioration among the elements.

Figure 21:
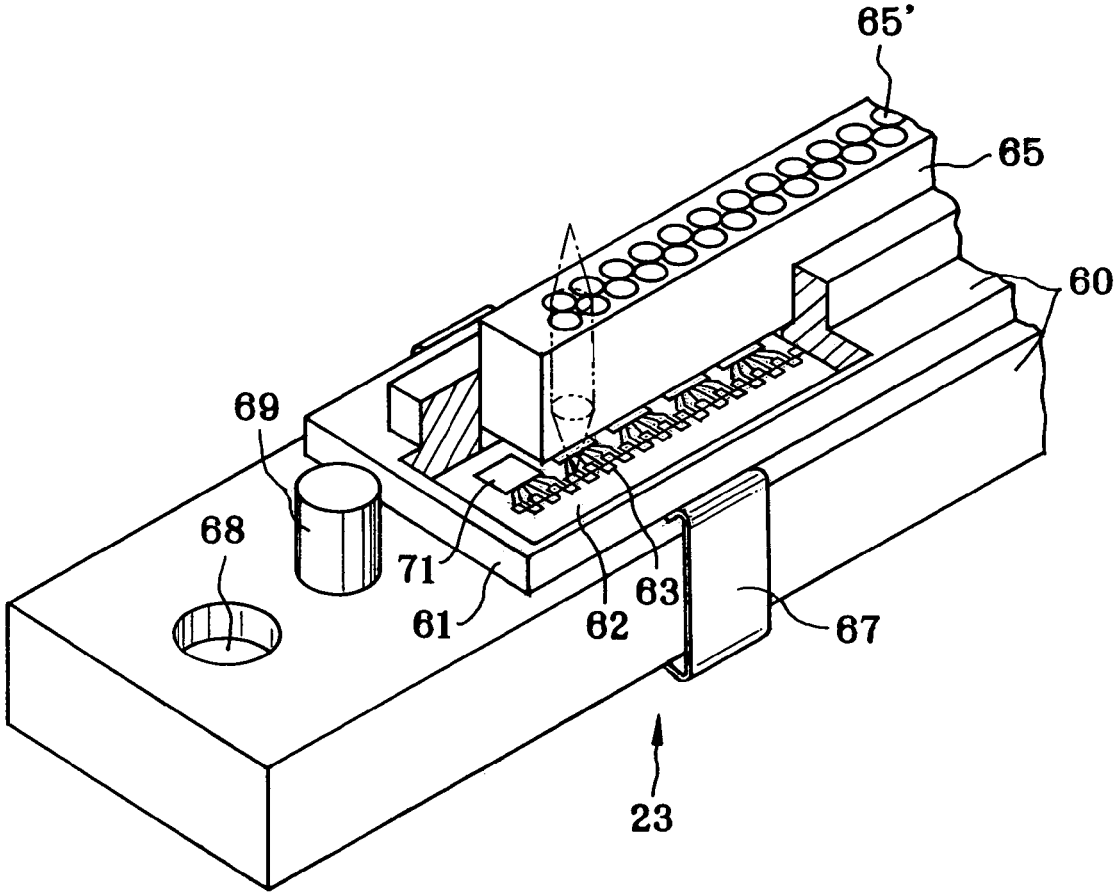
FIG. 21 is a perspective view showing an example of a line head.

Now, another embodiment of the present invention for solving such problems will be described. FIG. 21 is a perspective enlarged view schematically showing a line head of the image writing means 23 shown in FIG. 1. In FIG. 21, details of the line head of the image writing means 23 are shown. A mechanism for positioning the image writing means 23 relative to the image carrier (photosensitive drum) 20 attached to the image carrier unit 25 is shown. The image carrier 20 is rotatably attached to the casing 50 of the image carrier unit 25 by its shaft. On the other hand, the organic EL light emitting element array 61 is held in the housing 60 having a long rectangular shape. Positioning pins 69 which are disposed on both end portions of the long housing 60 are fitted in corresponding positioning holes of the casing 50. Then, fixing screws are screwed into the screw holes of the casing 50 through holes 68 formed in the both end portions of the long housing 60, thereby fixing the long housing 60. In this manner, the respective image writing means 23 are fixed at the predetermined positions.

The image writing means 23 comprises a glass substrate 62 and a light emitting part 63 of the organic EL light emitting element array 61 on the glass substrate 62 and is driven by TFTs 71 formed on the same glass substrate 62. A gradient index type rod lens array 65 composes an imaging optical system and is composed of gradient index type rod lenses 65' aligned in zigzag fashion and is disposed in front of the light emitting part 63. Numeral 60 designates a housing and 66 designates a cover. The housing 60 covers the periphery of the glass substrate 62 and opens at the side facing the image carrier 20. With this structure, light rays are incident on the image carrier 20 from the gradient index type rod lenses 65'. A light absorbing member (paint) is provided on surfaces of the housing 60 confronting the ends of the grass substrate 62.

Figure 22:
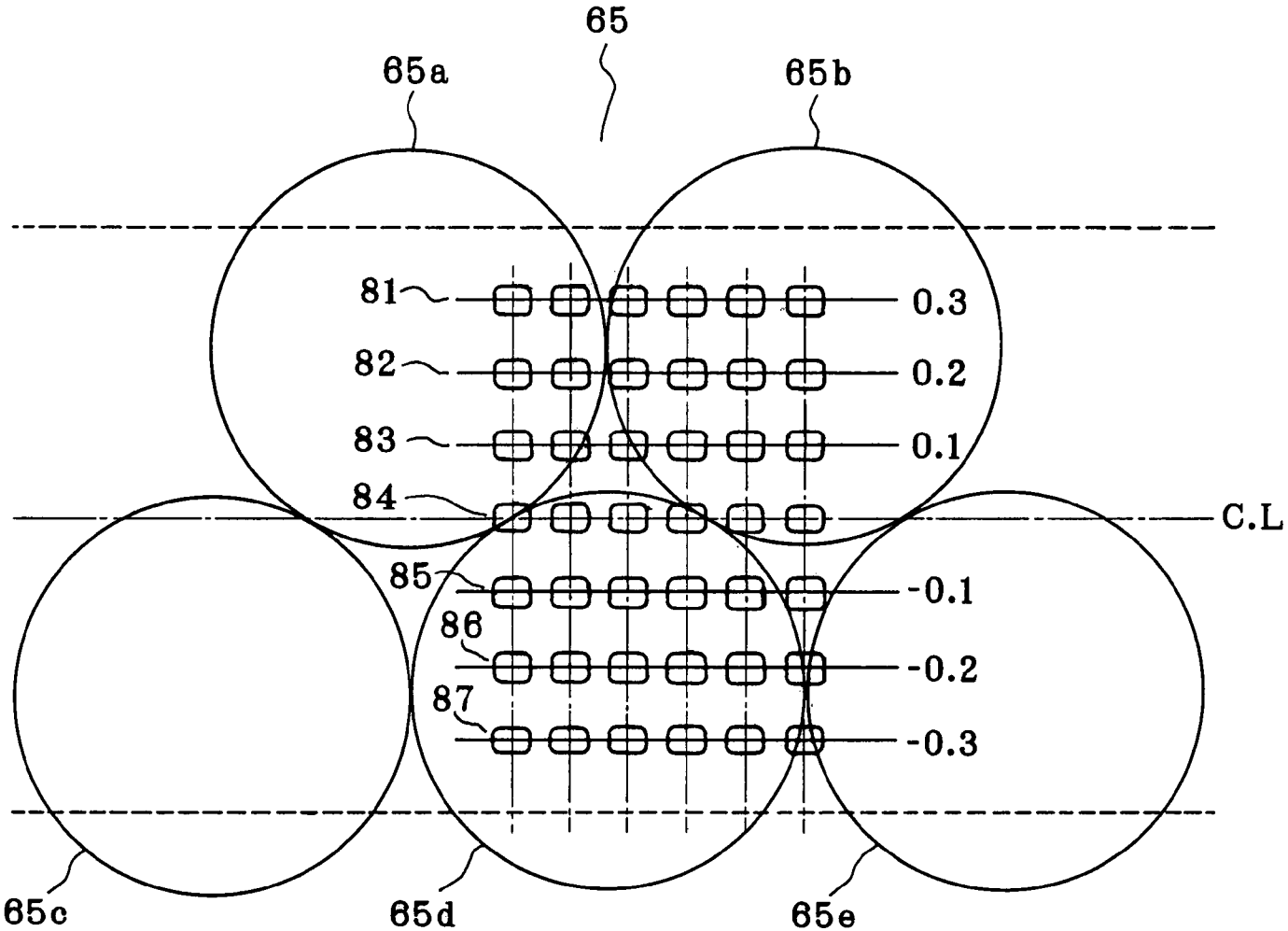
FIG. 22 is d plan view partially showing the line head.

FIG. 22 is a plan view partially showing the line head. In FIG. 22, in the rod lens array 65, the rod lenses 65*a*-65*e* are aligned in two lines in zigzag fashion. Numerals 81-87 designate light emitting element lines each of which comprises a plurality of light emitting elements from 0.3 to −0.3. In this example, the light emitting element lines 81-87 composed of the light emitting elements of equal size are arranged to symmetrical structure relative to a center line (axis) C.L of the rod lens array 65. That is, the light emitting element lines 81 and 87 are arranged at symmetrical positions relative to the center axis. The light emitting element lines 82 and 86, 83 and 85 are also arranged at symmetrical positions relative to the center axis. In the example of FIG. 22, the light emitting element lines 81-87 are arranged in a plurality of rows in parallel to the sub scanning direction of the image carrier, as the light emitting element lines capable of exposing the entire printing range to light.

The light emitting element lines are spaced apart from each other at equal distance. Therefore, it can be designed such that the timing of moving the image carrier and the timing of switching from the light emitting element line of which elements already emitted light to the next light emitting element line are coincident with each other for conducting the multiple recording of pixels by using the respective light emitting element lines, thereby achieving the simple control. In the example of FIG. 22, a light emitting element line is disposed even on the center axis C.L of the rod lens array 65. Accordingly, the light emission timing in the sub scanning direction for conducting the multiple exposure can be controlled on the basis of the light emitting element line on the center axis, thereby simplifying the structure of the control circuit.

Figure 23:
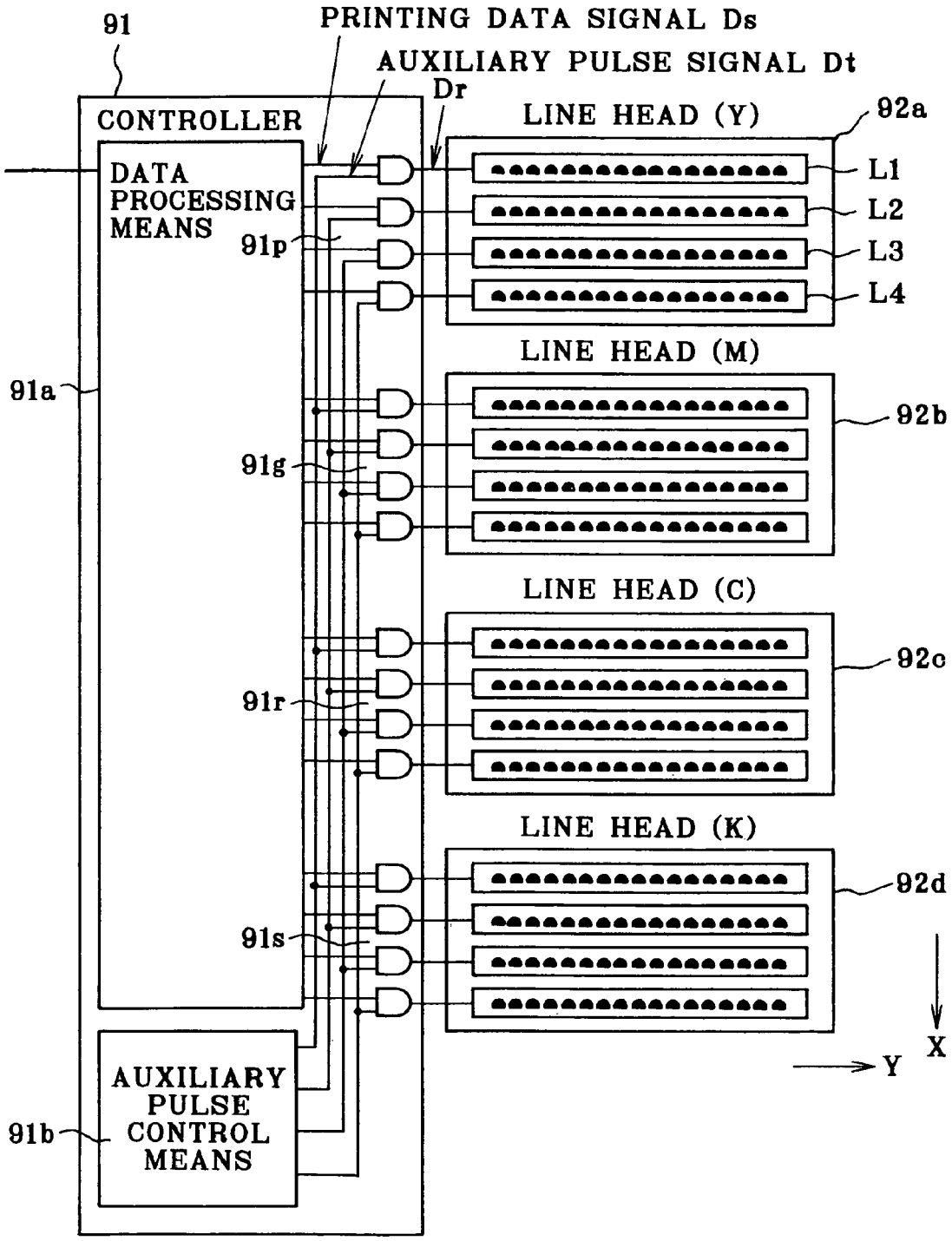
FIG. 23 is a block diagram showing an example of a control circuit.
Figure 24A:
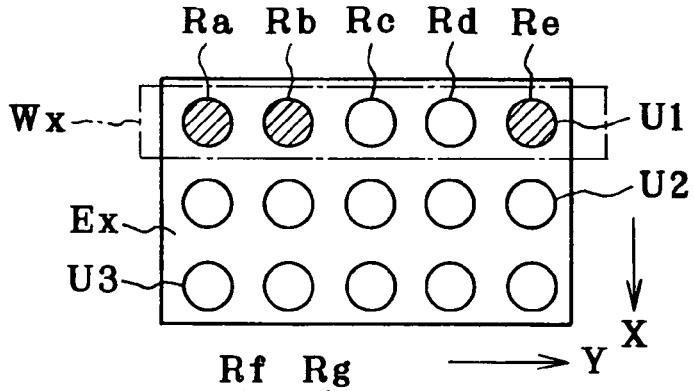
FIGS. 24A-24D are explanatory views showing the structure of the present invention.
Figure 24B:
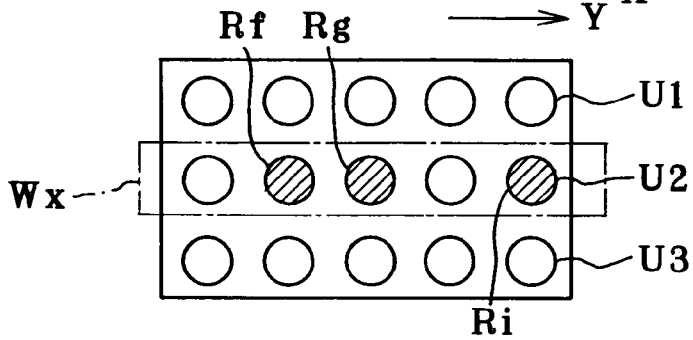
Figure 24C:
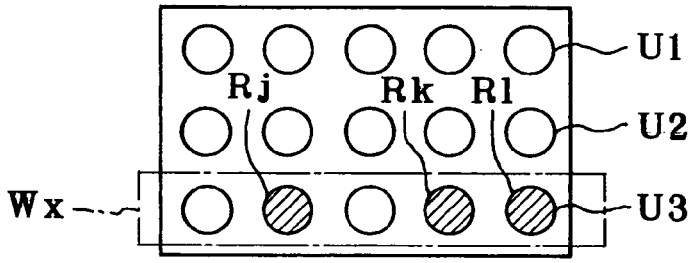
Figure 24D:
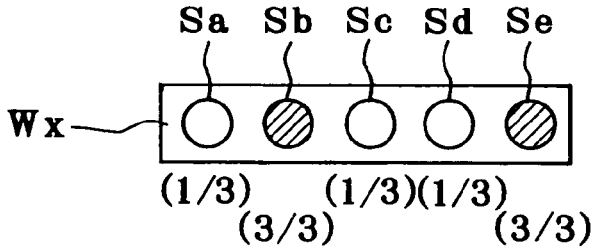
Figure 25A:
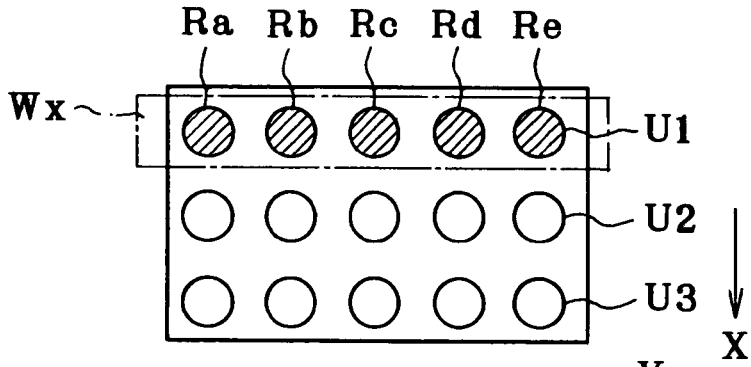
FIGS. 25A-25D are explanatory views showing another embodiment of the present invention.
Figure 25B:
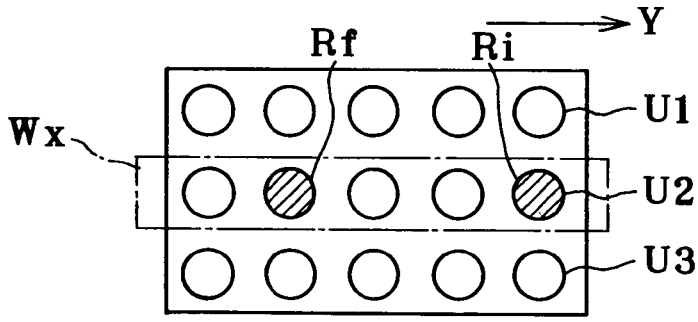
Figure 25C:
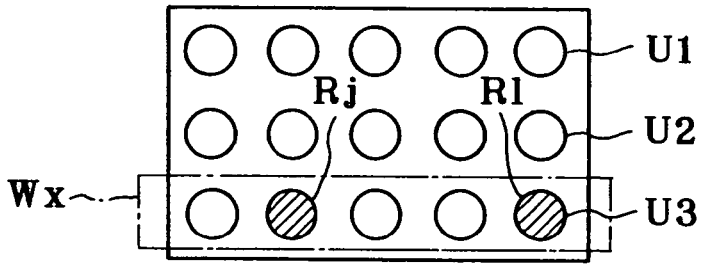
Figure 25D:
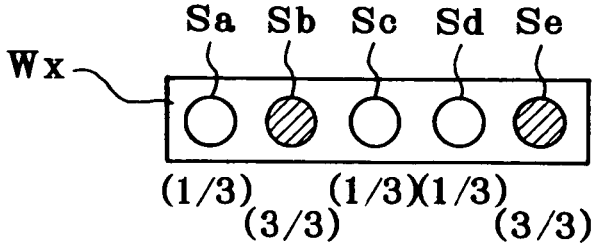

FIG. 23 is a block diagram showing an example of the control circuit. In FIG. 23, a control circuit 91 has a data processing means 91*a* and an auxiliary pulse control means 91*b*. The data processing means 91*a* performs the color separation, the gradation treatment, the bit-mapping of image data, and the compensation of color registration error according to the print data transmitted from the main controller 95. Line heads 92*a*-92*d* correspond to yellow (Y), magenta (M), cyan (C), and black (K) and form unicolor images on the photoreceptor, respectively. Each of the line heads 92*a*-92*d* is composed of organic EL elements aligned in plural lines arranged in the sub scanning direction of the image carrier.

For example, the line head 92*a* corresponding to yellow (Y) has four light emitting element lines L1-L4 which are aligned in the sub scanning direction X of the image carrier. In each light emitting element line, a plurality of organic EL elements are aligned in the main scanning direction of the image carrier. Since the light emitting element lines L1-L4 are arranged, the corresponding light emitting elements of the respective lines repeatedly expose the same pixel to light, whereby the line head is structured to be able to conduct multiple exposure. The data processing means 91*a* outputs a printing data signal Ds for every line of the line heads 92*a*-92*d*. The auxiliary pulse control means 91*b* outputs an auxiliary pulse signal Dt for every line of the line heads 92*a*-92*d*. Numerals 91*p*-91*s* designate AND circuits each of which opens a gate to send out driving signal Dr to the selected light emitting element line when receiving the printing data signal Ds and the auxiliary pulse signal Dt. The individual organic EL elements in each light emitting element line of each line head 92*a*-92*d* are operated by a driving circuit according to the active matrix method. For this, another means for further selecting individual organic EL element(s) in the selected light emitting element line is provided, thereby selecting individual organic El element(s) to emit light.

FIGS. 24(*a*)-24(*d*) are explanatory views according to an embodiment of the present invention. It is assumed that an image pixel line Wx of the image carrier includes pixels Sa, Sc, Sd as non-printing portions and pixels Sb, Se as printing portions. A plurality of (three) lines U1, U2, U3 each having a plurality of (five) organic EL elements aligned in the main scanning direction Y of the image carrier are aligned in the sub scanning direction X. Organic EL elements are arranged in the two-dimensional array to have predetermined image forming range Ex. In FIG. 24(*a*), a single light emitting element line U1 has organic EL elements Rb, Recorresponding to the pixels as printing portions and organic EL elements Ra, Rc, Rd corresponding to the pixels as non-printing portions.

In the state shown in FIG. 24(*a*), a pulse is applied to the organic EL element Ra corresponding to the pixel as non-printing portion and the organic EL elements Rb, Re corresponding to the pixels as printing portions so that these organic EL elements emit lights during one scanning action. Next, the image carrier is moved in the sub scanning direction X to the state as shown in FIG. 24(*b*) to bring the image pixel line Wx to correspond to the light emitting element line U2. In this state; a pulse is applied to the organic EL element Rg corresponding to the pixel as non-printing portion and the organic EL elements Rf, Ri corresponding to the pixels as printing portions so that these organic EL elements emit lights during one scanning action. Sequentially, the image carrier is moved in the sub scanning direction X to the state as shown in FIG. 24(*c*) to bring the image pixel line Wx to correspond to the light emitting element line U3. In this state, a pulse is applied to the organic EL element Rk corresponding to the pixel as non-printing portion and the organic EL elements Rj, Rl corresponding to the pixels as printing portions so that these organic EL elements emit lights during one scanning action.

In FIGS. 24(*a*)-24(*c*), at least one organic EL element of the organic EL elements for forming a latent image of the same dot by means of multiple exposure is lighted at least once during one scanning action. The subjects of this process include organic EL elements corresponding to the printing portions and organic EL elements corresponding to the non-printing portions. Accordingly, all of the organic EL elements have the opportunity to be lighted so as to prevent the generation of different in temperature among the organic EL elements, thus inhibiting the variation in light emission.

As shown in FIG. 24(*d*), the exposure amount of each of pixels Sa, Sc, Sd as non-printing portions is one third of that of the printing portion. That is, when the multiple exposure is conducted, the organic EL elements corresponding to the non-printing portions are lighted equally, thereby reducing the temperature difference relative to the organic EL elements corresponding to the printing portions. Therefore, the variation in amount of emitted light can be inhibited. As for the organic EL elements corresponding to the non-printing portions, the selected one is changed every main scanning not to form image on the image carrier. Since all of the organic EL elements have opportunities to be lighted, the levels of deterioration of the organic EL elements can be uniformed, thereby inhibiting the variation in amount of emitted light. Since only one of the organic EL elements corresponding to each non-printing portion is lighted, the latent image on the photoreceptor does not go far enough to form a toner image, thus not affecting the image formation. Therefore, the temperature of the organic EL elements can be increased so as to obtain stable amount of light without effect on the image formation. Though the control for the organic EL elements corresponding to the non-printing portion has been described in the aforementioned embodiment, the control can be adopted to the control for the organic EL elements corresponding to non-image portions such as margins.

FIGS. 25(*a*)-25(*d*) are explanatory views according to another embodiment of the present invention. The same numerals are used for portions corresponding to the portions shown in FIGS. 24(*a*)-24(*d*). In the state shown in FIG. 25(*a*), the image pixel lines Wx is brought to correspond to the light emitting element line U1. In this state, all of the organic EL elements Ra-Re corresponding to the non-printing portions and the printing portions are lighted, that is, all-element lighting is conducted at the light emitting element line U1 during one scanning action. Next, in the state as shown in FIG. 25(*b*), the image pixel line Wx is brought to correspond to the light emitting element line U2. In this state, the organic EL elements Rf, Ri corresponding to the printing portions are lighted during one scanning action. Further, in the state as shown in FIG. 25(*c*), the image pixel line Wx is brought to correspond to the light emitting element line U3. In this state, the organic EL elements Rj, Rl corresponding to the printing portions are lighted during one scanning action.

In this case, as shown in FIG. 25(*d*), the exposure amount of each of pixels Sa, Sc, Sd as non-printing portions is one third of that of the printing portion. That is, the organic EL elements corresponding to the non-printing portions are lighted equally, thereby reducing the temperature difference relative to the organic EL elements corresponding to the printing portions. Therefore, the variation in amount of emitted light can be inhibited. Since the all-element lighting of the organic EL elements is conducted at a single line, the control of lighting the organic EL elements can be simplified.

Figure 26:
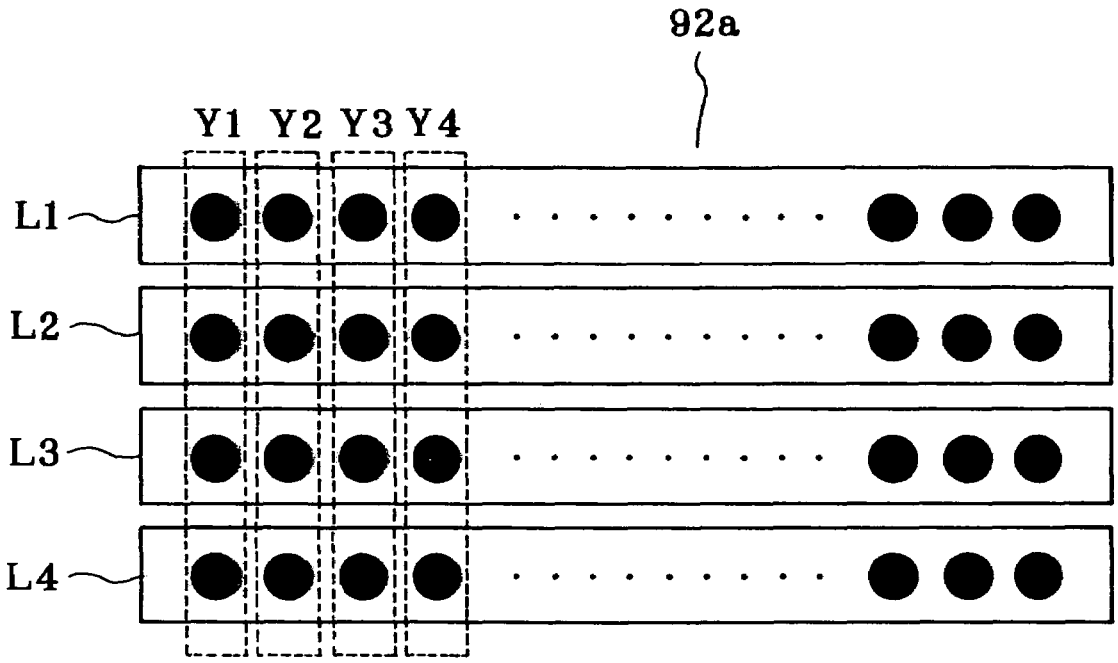
FIG. 26 is an explanatory view showing another embodiment of the present invention.

FIG. 26 is an explanatory view showing an example of the control for the organic EL elements according to another embodiment of the present invention. In FIG. 26, the description will be made by taking the line head 92*a* shown in FIG. 23 as an example. Also in the example of FIG. 26, a plurality of light emitting element lines each having a plurality of organic EL elements aligned in the main scanning direction of the image carrier are aligned in the sub scanning direction. Organic EL elements are arranged in the two-dimensional array. Black circles indicate individual organic EL elements. Y1, Y2, Y3, . . . indicate groups of organic EL elements, respectively, the organic EL elements in each group being aligned in the sub scanning direction for repeatedly exposing the same dot by moving the image carrier in the sub scanning direction X, thus conducting the multiple exposure. That is, the organic EL elements in each group have a function of forming a latent image of the same dot when the multiple exposure is conducted. In the example shown in FIG. 26, each group Y1, Y2, Y3, . . . consists of four organic EL elements which are arranged in the light emitting element lines L1-L4, respectively. Therefore, one pixel can be repeatedly exposed four times by the organic EL elements in each group Y1, Y2, Y3, . . .

As shown in FIG. 26, the line head 92*a* comprises a plurality of organic EL elements arranged in the two-dimensional array in the main scanning direction Y and the sub scanning direction X of the image carrier. The organic EL elements form groups (Y1, Y2, Y3, . . . ) for forming latent images of the same dots, as mentioned above. This embodiment is characterized in that at least one of the organic EL elements in the group corresponding to a non-printing portion, such as a space between characters or a space between lines, or a non image portion (blank) is lighted. Since only one of the organic EL elements corresponding to each non-printing portion is lighted, the latent image on the photoreceptor does not go far enough to forma toner image, thus not affecting the image formation. Therefore, the temperature of the organic EL elements can be increased so as to obtain stable amount of light without effect on the image formation. In addition, the levels of deterioration of the organic EL elements can be uniformed, thereby inhibiting the variation in amount of emitted light.

The example of FIG. 26 is structured such that at least one of the organic EL elements in each group is lighted at least once during one main scanning. For example, during the first main scanning, the organic EL elements at Y1-L1, Y2-L2, Y3-L3, Y4-L4 . . . are lighted. Then, during the second main scanning, the organic EL elements at Y1-L2, Y2-L3, Y3-L4, Y4-L5 are lighted. To achieve the aforementioned control, an auxiliary pulse signal Dt as shown in FIG. 23 is sent out from the data processing means 91*a*. During this, the timing of moving the image carrier and the timing of lighting the organic EL elements must be adjusted not to form image on non-printing portions of the image carrier. In this case, there is an advantage that all of the organic EL elements can be equally lighted.

In another embodiment of the present invention, organic EL elements of at least one of the lines in the main scanning direction at a non-printing portion such as a space between characters or a space between lines or at a non image portion (blank) are all lighted, i.e. all-element lighting in the line is achieved, and the line to be subjected to the all-element lighting is switched at predetermined interval, for example, interval for changing a paper sheet. In the example of FIG. 26, the light emitting element lines L1-L4 are subjected to the all-element lightning at predetermined interval. In this case, since the all-element lighting of the organic EL element is conducted at a single line, the control of lighting all the organic EL elements can be simplified. In this case, the latent image on the photoreceptor does not go far enough to forma toner image, thus not affecting the image formation.

In another embodiment of the present invention, the organic EL elements of one line are all lighted once every main scanning and the line to be lighted is changed every main scanning. In the example of FIG. 24, the light emitting element line L1 is subjected to the all-element lighting during the first scanning. The light emitting element line L2 is subjected to the all-element lighting during the second main scanning. After that, each light emitting element line is subjected to the all-element lighting sequentially. By conducting the control as mentioned above, all of the organic EL elements can be equally lighted and this all-element lighting can be conducted without adding time. Therefore, stable amount of lights can be obtained by all of the organic EL elements.

In another embodiment of the present invention, as a light emitting element line is positioned at peripheral side farther from the center axis of the rod lens array, the number of times of all-element lightning to the light emitting element line is set to be higher. In the example of FIG. 26, it is assumed that the light emitting element line L1 is positioned far from the center axis of the rod lens array. In this case, the number of times of all-element lighting to the light emitting element line L1 is set to be higher than that of the other light emitting element lines L2, L3 which are near the center axis of the rod lens array.

Generally, organic EL elements have a tendency that elements farthest from the center axis of the rod lens array have the largest variation in amount of light. By increasing the number of times of all-element lightning relative to organic EL elements at a peripheral side, the variation in amount of light can be reduced.

Though the image forming apparatus and the image forming method of the present invention have been described with reference to the embodiments, the present invention is not limited to these embodiments and various modifications can be made.

What we claim is:

1. An image forming apparatus comprising: an image writing means employing organic EL elements; a direct current voltage applying means for applying a direct current voltage to said organic EL elements; and a control means for said direct current voltage applying means; wherein said control means controls said direct current voltage applying means to apply a direct current voltage (Va), higher than 0V and lower than a threshold voltage, to said organic EL elements during non-printing, and at the start of said image writing means, said direct current voltage (Va) is applied to said organic EL elements and then the image writing means is shifted to the printing state.

2. An image forming apparatus as claimed in claim 1, wherein said image writing means comprises a line head composed of light emitting element lines each of which has a plurality of organic EL elements aligned in the main scanning direction of the image carrier.

3. An image forming apparatus as claimed in claim 2, wherein said line head is composed of a plurality of said light emitting element lines aligned in the sub scanning direction.

4. An image forming apparatus as claimed in claim 3, wherein, when conducting multiple exposure by said image writing means, said direct current voltage applying means is controlled to apply a direct current voltage, higher than 0V and lower than the threshold voltage, to all organic EL elements arrange in at least one of the light emitting element lines.

5. An image forming apparatus as claimed in claim 3, wherein said direct current voltage applying means is controlled to apply a direct current voltage, higher than 0V and lower than the threshold voltage, to at least one of the organic EL elements arranged in said light emitting element lines.

6. An image forming apparatus comprising: an image carrier cartridge employing a line head composed of organic EL elements to which the control as claimed in any one of claims 2-5 is conducted, and comprising a charging means, an exposure means, a developing means, and a transfer means which are arranged around an image carrier, wherein said image forming apparatus transfers a toner image formed on said image carrier onto a transfer medium.

7. An image forming apparatus as claimed in any one of claims 1 and 2-5, wherein said organic EL elements are controlled according to the intensity modulating control.

8. An image forming apparatus as claimed in claim 7, wherein said organic EL elements are connected to a driving circuit according to the active matrix method.

9. An image forming apparatus comprising: an image carrier cartridge employing a line head composed of organic EL elements to which the control as claimed in claim 7 is conducted, and comprising a charging means, an exposure means, a developing means, and a transfer means which are arranged around an image carrier, wherein said image forming apparatus transfers a toner image formed on said image carrier onto a transfer medium.

10. An image forming apparatus as claimed in any one of claims 1 and 2-5, wherein said organic EL elements are connected to a driving circuit according to the active matrix method.

11. An image forming apparatus comprising: an image carrier cartridge employing a line head composed of organic EL elements to which the control as claimed in claim 10 is conducted, and comprising a charging means, an exposure means, a developing means, and a transfer means which are arranged around an image carrier, wherein said image forming apparatus transfers a toner image formed on said image carrier onto a transfer medium.

12. An image forming apparatus comprising: an image carrier, an image writing means employing organic EL elements, a direct current voltage applying means for applying a direct current voltage to said organic EL elements; and a control means for said direct current voltage applying means; wherein said control means controls said direct current voltage applying means to apply a direct current voltage (Va), higher than a threshold voltage and lower than the voltage applied for printing, to said organic EL elements during non-printing with said image carrier being moved.

13. An image forming apparatus as claimed in claim 12, wherein, at the start of said image writing means, said direct current voltage (Va) is applied to said organic EL elements and then the image writing means is shifted to the printing state.

14. An image forming apparatus as claimed in claim 12 or 13, wherein said image writing means comprises a line head composed of light emitting element lines each of which has a plurality of organic EL elements aligned in the main scanning direction of the image carrier.

15. An image forming apparatus as claimed in claim 14, wherein said line head is composed of a plurality of said light emitting element lines aligned in the sub scanning direction.

16. An image forming apparatus as claimed in claim 14, wherein, when conducting multiple exposure by said image writing means, said direct current voltage applying means is controlled to apply a direct current voltage, higher than a threshold voltage and lower than the voltage applied for printing, to all organic EL elements arrange in at least one of the light emitting element lines.

17. An image forming apparatus as claimed in claim 14, wherein said organic EL elements are controlled according to the intensity modulating control.

18. An image forming apparatus as claimed in claim 14, wherein said organic EL elements are connected to a driving circuit according to the active matrix method.

19. An image forming apparatus comprising: an image carrier cartridge employing a line head composed of organic EL elements to which the control as claimed in claim 14 is conducted, and comprising a charging means, an exposure means, a developing means, and a transfer means which are arranged around an image carrier, wherein said image forming apparatus transfers a toner image formed on said image carrier onto a transfer medium.

20. An image forming apparatus as claimed in claim 15, wherein said direct current voltage applying means is controlled to apply a direct current voltage, higher than a threshold voltage and lower than the voltage applied for printing, to at least one of the organic EL elements arranged in said light emitting element lines.

21. An image forming apparatus comprising: an image carrier cartridge employing a line head composed of organic EL elements to which the control as claimed in any one of claims 15-20 is conducted, and comprising a charging means, an exposure means, a developing means, and a transfer means which are arranged around an image carrier, wherein said image forming apparatus transfers a toner image formed on said image carrier onto a transfer medium.

22. An image forming apparatus as claimed in claim 15, wherein, when conducting multiple exposure by said image writing means, said direct current voltage applying means is controlled to apply a direct current voltage, higher than a threshold voltage and lower than the voltage applied for printing, to all organic EL elements arrange in at least one of the light emitting element lines.

23. An image forming apparatus as claimed in any one of claims 12, 13, and 15-20, wherein said organic EL elements are controlled according to the intensity modulating control.

24. An image forming apparatus as claimed in claim 23, wherein said organic EL elements are connected to a driving circuit according to the active matrix method.

25. An image forming apparatus comprising: an image carrier cartridge employing a line head composed of organic EL elements to which the control as claimed in claim 23 is conducted, and comprising a charging means, an exposure means, a developing means, and a transfer means which are arranged around an image carrier, wherein said image forming apparatus transfers a toner image formed on said image carrier onto a transfer medium.

26. An image forming apparatus as claimed in any one of claims 12, 13, and 15-20, wherein said organic EL elements are connected to a driving circuit according to the active matrix method.

27. An image forming apparatus comprising: an image carrier cartridge employing a line head composed of organic EL elements to which the control as claimed in claim 26 is conducted, and comprising a charging means, an exposure means, a developing means, and a transfer means which are arranged around an image carrier, wherein said image forming apparatus transfers a toner image formed on said image carrier onto a transfer medium.

28. An image forming apparatus comprising: an image writing means employing organic EL elements and a control unit for said organic EL elements, wherein said control unit applies a voltage of opposite bias polarity i.e. a voltage of a polarity opposite to that of the voltage of bias polarity for light emission (voltage of emission polarity).

29. An image forming apparatus as claimed in claim 28, wherein the absolute value of said voltage of the opposite bias polarity is set to be larger than the absolute value of said voltage of the emission polarity.

30. An image forming apparatus as claimed in claim 28, wherein the product of said voltage of the opposite bias polarity and its applying time is set to be larger than the product of said voltage of the emission polarity and its applying time.

31. An image forming apparatus as claimed in claim 28, wherein at the start of said organic EL elements, said voltage of the opposite bias polarity is applied to the organic EL elements prior to the application of said voltage of the emission polarity.

32. An image forming apparatus as claimed in claim 28, wherein the voltage of the opposite bias polarity and the voltage of the emission polarity are alternatively applied to said organic EL elements.

33. An image forming apparatus as claimed in any one of claims 28 through 32, wherein said organic EL elements are connected to a driving circuit according to the active matrix method.

34. An image forming apparatus comprising: an image carrier cartridge employing a line head composed of organic EL elements to which the control as claimed in claim 33 is conducted, and comprising a charging means, an exposure means, a developing means, and a transfer means which are arranged around an image carrier, wherein said image forming apparatus transfers a toner image formed on said image carrier onto a transfer medium.

35. An image forming apparatus comprising: an image carrier cartridge employing a line head composed of organic EL elements to which the control as claimed in any one of claims 28-32 is conducted, and comprising a charging means, an exposure means, a developing means, and a transfer means which are arranged around an image carrier, wherein said image forming apparatus transfers a toner image formed on said image carrier onto a transfer medium.

36. An image forming apparatus comprising: a charge bias applying means for a photoreceptor, a development bias applying means, organic EL elements in groups for forming an image on an image carrier, and a density control means for patch images, wherein said organic EL elements in group(s) are controlled to be all lighted before formation of the patch images, and said organic EL elements in group(s) are controlled to be all lighted before application of the charge bias to said photoreceptor.

37. An image forming apparatus as claimed in claim 36, wherein said organic EL elements in group(s) are controlled to be all lighted before application of the development bias.

38. An image forming apparatus as claimed in 36 or 37, wherein said organic EL elements in groups are controlled to be all lighted at pauses in application of development bias.

39. An image forming apparatus comprising: a charge bias applying means for a photoreceptor, a development bias applying means, organic EL elements in groups for forming an image on an image carrier, and a density control means for patch images, wherein it is controlled to form patch images in an order from the highest density to the lowest density stepwise, and said patch images are formed by controlling at least organic EL elements in group(s) which form the patch images to be all lighted.

40. An image forming apparatus comprising: a charge bias applying means for a photoreceptor, a development bias applying means, organic EL elements in groups for forming an image on an image carrier, and a density control means for patch images, wherein said organic EL elements in group(s) are controlled to be all lighted before formation of the patch images and it is controlled to form patch images in an order from the highest density to the lowest density stepwise, and wherein said organic EL elements in group(s) are controlled to be all lighted before application of the charge bias to said photoreceptor.

41. An image forming apparatus as claimed in claim 40, wherein said patch images are formed by controlling at least organic EL elements in group(s) which form the patch images to be all lighted.

42. An image forming apparatus as claimed in claim 40, wherein said organic EL elements in group(s) are controlled to be all lighted before application of the development bias.

43. An image forming apparatus as claimed in claim 40, wherein said organic EL elements in group(s) are controlled to be all lighted at pauses in application of development bias.

44. An image forming apparatus comprising: an image writing means having a plurality of light emitting element lines aligned in the sub scanning direction of an image carrier, each light emitting element line being composed of a plurality of organic EL elements aligned in the main scanning direction of the image carrier and arranged two-dimensionally; and a control unit for said organic EL elements; wherein said control unit controls such that organic EL element of least one of the light emitting element lines arranged in the main scanning direction are all lighted and the line to be subjected to the all-element lighting is switched at predetermined interval.

45. An image forming apparatus as claimed in claim 44, wherein said control unit controls such that the organic EL elements of one light emitting element line are all lighted once every formation of latent image of one main scanning line and the line to be all lighted is changed every main scanning line.

46. An image forming apparatus as claimed in claim 44, wherein said control unit controls such that the number of times of all-element lightning to a light emitting element line is set to be higher when the light emitting element line is positioned farther from the center axis of a rod lens array.

47. An image forming apparatus as claimed in claim 44, wherein said control unit controls such that the light emitting element line to be all lighted is changed every formation of image on page when the image is formed on a full page.

48. An image forming apparatus comprising: an image writing means having a plurality of light emitting element lines aligned in the sub scanning direction of an image carrier, each light emitting element line being composed of a plurality of organic EL elements aligned in the main scanning direction of the image carrier and arranged two-dimensionally; and a control unit for said organic EL elements; wherein said control unit controls such that at least one organic EL elements of the plural organic EL elements for forming a latent image of the same dot by means of multiple exposure is lighted at least once during the formation of the latent image of the same dot.

49. An image forming apparatus as claimed in claim 48, wherein said control unit controls such that the organic EL elements corresponding to non-printing portions or non-image portions among said organic EL elements are at least once during the formation of the latent image of the same dog.

50. An image forming apparatus as claimed in any one of claims 48 through 47, wherein said organic EL elements are connected to a driving circuit according to the active matrix method.

51. An image forming apparatus comprising: an image carrier cartridge employing a line head composed of organic EL elements to which the control as claimed in claim 50 is conducted, and comprising a charging means, an exposure means, a developing means, and a transfer means which are arranged around an image carrier, wherein said image forming apparatus transfers a toner image formed on said image carrier onto a transfer medium.

52. An image forming apparatus comprising: an image carrier cartridge employing a line head composed of organic EL elements to which the control as claimed in any one of claims 48-47 is conducted, and comprising a charging means, an exposure means, a developing means, and a transfer means which are arranged around an image carrier, wherein said image forming apparatus transfers a toner image formed on said image carrier onto a transfer medium.

* * * * *